US008446800B2

(12) United States Patent
Abe

(10) Patent No.: US 8,446,800 B2
(45) Date of Patent: May 21, 2013

(54) TIME INFORMATION ACQUISITION APPARATUS AND RADIO WAVE TIMEPIECE

(75) Inventor: Hideo Abe, Tokorozawa (JP)

(73) Assignee: Casio Computer Co., Ltd, Tokyo (JP)

( * ) Notice: Subject to any disclaimer, the term of this patent is extended or adjusted under 35 U.S.C. 154(b) by 218 days.

(21) Appl. No.: 13/086,484

(22) Filed: Apr. 14, 2011

(65) Prior Publication Data

US 2011/0255377 A1 Oct. 20, 2011

(30) Foreign Application Priority Data

Apr. 16, 2010 (JP) ..... 2010-095021
Apr. 16, 2010 (JP) ..... 2010-095022

(51) Int. Cl.
*G04C 11/02* (2006.01)

(52) U.S. Cl.
USPC ..... 368/47

(58) Field of Classification Search ..... 368/47; 375/134, 375/137, 145, 149, 355; 455/181.1, 171.1, 455/231, 108, 110, 205, 210, 456.1–456.6, 455/457; 702/66, 69, 71–74, 189
See application file for complete search history.

(56) References Cited

U.S. PATENT DOCUMENTS 7,224,260 B1 * 5/2007 Nowak ..... 340/286.02
7,865,324 B2 * 1/2011 Lindberg et al. ..... 702/94
2003/0184275 A1 * 10/2003 Slade et al. ..... 324/66
2008/0212416 A1 * 9/2008 Polonio et al. ..... 368/244
2009/0231963 A1 * 9/2009 Abe ..... 368/47
2009/0248357 A1 * 10/2009 Abe ..... 702/176
2010/0014388 A1 * 1/2010 Abe ..... 368/47

FOREIGN PATENT DOCUMENTS

JP 2003-222687 8/2003
JP 2005-249632 9/2005
JP 2008-032583 2/2008
JP 2009-216544 9/2009

* cited by examiner

*Primary Examiner* — Amy Cohen Johnson
*Assistant Examiner* — Matthew Powell
(74) *Attorney, Agent, or Firm* — Turocy & Watson, LLP

(57) ABSTRACT

A time information acquisition apparatus comprises an input waveform data pattern generator configured to sample a standard time radio wave signal in order to generate an input waveform data pattern, a predicted waveform data pattern generator configured to generate predicted waveform data patterns, represents a string of codes based on a base time, and has a head position, an error detector configured to detect non-coincidence between the input waveform data pattern and each of the predicted waveform data patterns in order to acquire a number of errors indicative of a number of non-coincidences, a current time correction module configured to correct the base time based on the predicted waveform data pattern indicative of a minimum value of the number of errors, and a controller configured to determine the number of predicted waveform data patterns to be generated.

19 Claims, 19 Drawing Sheets

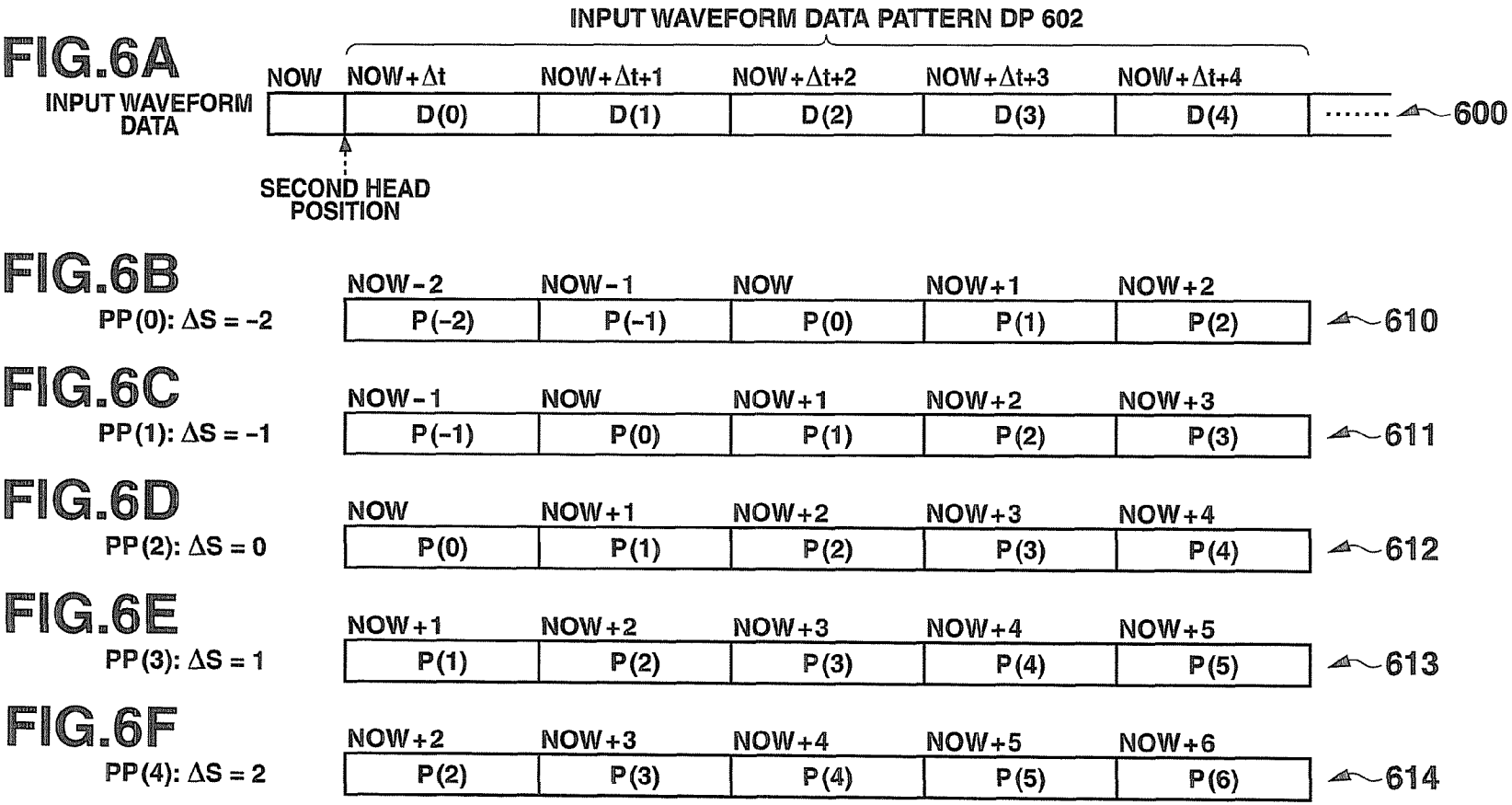
FIG.6A INPUT WAVEFORM DATA
FIG.6B PP(0): ΔS = -2
FIG.6C PP(1): ΔS = -1
FIG.6D PP(2): ΔS = 0
FIG.6E PP(3): ΔS = 1
FIG.6F PP(4): ΔS = 2

FIG.8A
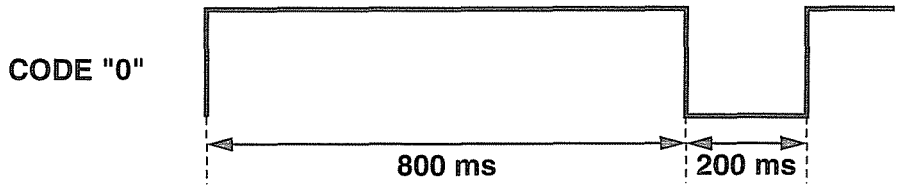
FIG.8B
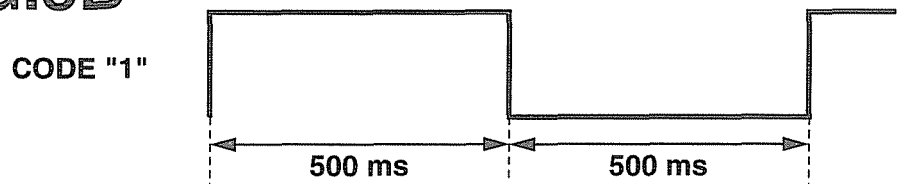
FIG.8C
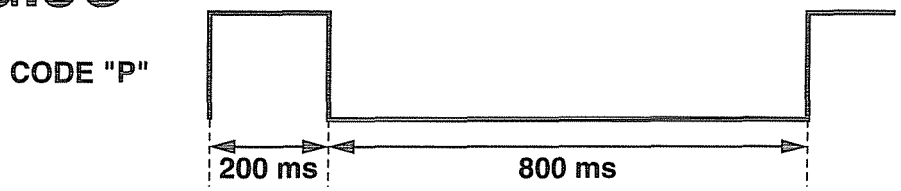
FIG.9
| RANGE OF NUMBER OF SAMPLES I | $BER_{max}(I)$ |
|---|---|
| : | : |
| $40 \leq I < 80$ | 0.1 |
| $80 \leq I < 120$ | 0.125 |
| $120 \leq I < 160$ | 0.175 |
| $160 \leq I < 200$ | 0.194 |
| $200 \leq I < 240$ | 0.21 |
| : | : |

INPUT WAVEFORM DATA

INPUT WAVEFORM DATA PATTERN

| | | | | | | | | | | | | | | | | |
|---|---|---|---|---|---|---|---|---|---|---|---|---|---|---|---|---|
| D(0, 0) | D(1, 0) | D(2, 0) | D(3, 0) | D(0, 1) | D(1, 1) | D(2, 1) | D(3, 1) | D(0, 2) | D(1, 2) | D(2, 2) | D(3, 2) | D(0, 3) | D(1, 3) | D(2, 3) | D(3, 3) | .... |

0s 1.0s 2.0s 3.0s 4.0s

| | | | | | | | | | | | | | | | | |
|---|---|---|---|---|---|---|---|---|---|---|---|---|---|---|---|---|
| | NOW−2 | | | | NOW−1 | | | | NOW | | | | NOW+1 | | | |
| PP(0): ΔS = −2 | P(0, −2) | P(1, −2) | P(2, −2) | P(3, −2) | P(0, −1) | P(1, −1) | P(2, −1) | P(3, −1) | P(0, 0) | P(1, 0) | P(2, 0) | P(3, 0) | P(0, 1) | P(1, 1) | P(2, 1) | P(3, 1) |

| | | | | | | | | | | | | | | | | |
|---|---|---|---|---|---|---|---|---|---|---|---|---|---|---|---|---|
| | NOW−1 | | | | NOW | | | | NOW+1 | | | | NOW+2 | | | |
| PP(1): ΔS = −1 | P(0, −1) | P(1, −1) | P(2, −1) | P(3, −1) | P(0, 0) | P(1, 0) | P(2, 0) | P(3, 0) | P(0, 1) | P(1, 1) | P(2, 1) | P(3, 1) | P(0, 2) | P(1, 2) | P(2, 2) | P(3, 2) |

| | | | | | | | | | | | | | | | | |
|---|---|---|---|---|---|---|---|---|---|---|---|---|---|---|---|---|
| | NOW | | | | NOW+1 | | | | NOW+2 | | | | NOW+3 | | | |
| PP(2): ΔS = 0 | P(0, 0) | P(1, 0) | P(2, 0) | P(3, 0) | P(0, 1) | P(1, 1) | P(2, 1) | P(3, 1) | P(0, 2) | P(1, 2) | P(2, 2) | P(3, 2) | P(0, 3) | P(1, 3) | P(2, 3) | P(3, 3) |

| | | | | | | | | | | | | | | | | |
|---|---|---|---|---|---|---|---|---|---|---|---|---|---|---|---|---|
| | NOW+1 | | | | NOW+2 | | | | NOW+3 | | | | NOW+4 | | | |
| PP(3): ΔS = 1 | P(0, 1) | P(1, 1) | P(2, 1) | P(3, 1) | P(0, 2) | P(1, 2) | P(2, 2) | P(3, 2) | P(0, 3) | P(1, 3) | P(2, 3) | P(3, 3) | P(0, 4) | P(1, 4) | P(2, 4) | P(3, 4) |

| | | | | | | | | | | | | | | | | |
|---|---|---|---|---|---|---|---|---|---|---|---|---|---|---|---|---|
| | NOW+2 | | | | NOW+3 | | | | NOW+4 | | | | NOW+5 | | | |
| PP(4): ΔS = 2 | P(0, 2) | P(1, 2) | P(2, 2) | P(3, 2) | P(0, 3) | P(1, 3) | P(2, 3) | P(3, 3) | P(0, 4) | P(1, 4) | P(2, 4) | P(3, 4) | P(0, 5) | P(1, 5) | P(2, 5) | P(3, 5) |

FIG.19

1900

| | | $E_1$ | | | | | |
|---|---|---|---|---|---|---|---|
| | | 1 | 2 | 3 | 4 | 5 | ····· |
| N | 1 | $E_{min}(1, 1)$ | $E_{min}(1, 2)$ | $E_{min}(1, 3)$ | $E_{min}(1, 4)$ | $E_{min}(1, 5)$ | ····· |
| | 2 | $E_{min}(2, 1)$ | $E_{min}(2, 2)$ | $E_{min}(2, 3)$ | $E_{min}(2, 4)$ | $E_{min}(2, 5)$ | ····· |
| | 3 | $E_{min}(3, 1)$ | $E_{min}(3, 2)$ | $E_{min}(3, 3)$ | $E_{min}(3, 4)$ | $E_{min}(3, 5)$ | ····· |
| | 4 | $E_{min}(4, 1)$ | $E_{min}(4, 2)$ | $E_{min}(4, 3)$ | $E_{min}(4, 4)$ | $E_{min}(4, 5)$ | ····· |
| | 5 | $E_{min}(5, 1)$ | $E_{min}(5, 2)$ | $E_{min}(5, 3)$ | $E_{min}(5, 4)$ | $E_{min}(5, 5)$ | ····· |
| | ⋮ | ⋮ | ⋮ | ⋮ | ⋮ | ⋮ | ⋮ |

TIME INFORMATION ACQUISITION APPARATUS AND RADIO WAVE TIMEPIECE

CROSS-REFERENCE TO RELATED APPLICATIONS

This application is based upon and claims the benefit of priority from prior Japanese Patent Applications No. 2010-095021, filed Apr. 16, 2010; and No. 2010-095022, filed Apr. 16, 2010, the entire contents of which are incorporated herein by reference.

BACKGROUND OF THE INVENTION

1. Field of the Invention

The present invention relates generally to a time information acquisition apparatus which receives a standard time radio wave to acquire time information thereof, and a radio wave timepiece on which the time information acquisition apparatus is mounted.

2. Description of the Related Art

In recent years, for example, in Japan, Germany, England, and Switzerland, transmitting stations transmit a standard time radio wave of a low frequency. For example, transmitting stations in Fukushima and Saga prefectures in Japan transmit amplitude-modulated standard time radio waves of 40 kHz and 60 kHz. The standard time radio wave includes a code string forming a time code indicating the date and time and is transmitted every 60 seconds. That is, the period of the time code is 60 seconds.

A clock (radio wave timepiece) that receives the standard time radio wave, extracts the time code from the received standard time radio wave, and corrects the time has been put to practical use. A receiver of the radio wave timepiece includes a band-pass filter (BPF) that receives the standard time radio wave through an antenna and extracts only the standard time radio wave signal, a demodulator that demodulates an amplitude-modulated standard time radio wave signal using, for example, envelope detection, and a processor that reads a time code included in the signal demodulated by the demodulator.

The processor in the prior art performs synchronization with the rising edge of the demodulated signal and then performs binarization with a predetermined sampling period to acquire time code output (TCO) data having a unit time length (one second), which is a binary bit string. The processor measures the pulse width (that is, the time of a bit 1 or the time of a bit 0) of the TCO data, determines whether each code is a binary 1 code, a binary 0 code, or a position marker code P based on the measured pulse width, and acquires time information based on the determined code string.

The processing circuit according to the prior art performs processes, such as a second synchronization process, a minute synchronization process, a process of acquiring a code, and a process of determining matching, during the period from the start of the reception of the standard time radio wave to the acquisition of the time information. When each of the processes is not appropriately terminated, the processing circuit needs to start the processes from the beginning. Therefore, in some cases, the processing circuit needs to start the processes from the beginning several times due to the influence of noise included in the signal. Under such instances, it takes a very long time to acquire time information.

The second synchronization detects the rising edge of a code at an interval of one second among the codes indicated by the TCO data. It is possible to detect a portion in which a position marker P0 arranged at the end of a frame and a marker M arranged at the head of the frame are continuously arranged by repeatedly performing the second synchronization. The portion in which the markers are continuously arranged appears at an interval of one minute (60 seconds). Within the TCO data, the marker M shows the position of the head frame data. The detection of the position of the marker is referred to as minute synchronization. The head of the frame is recognized by the minute synchronization. Therefore, after code acquisition starts to acquire one frame of data, a parity bit is checked to determine whether the data has an improper value (the date and time have improper values) (matching determination). For example, since the minute synchronization is for detecting the head of the frame, 60 seconds are required in some cases. Of course, multiples of 60 seconds are required to detect the heads of several frames.

In Jpn. Pat. Appln. KOKAI Publication No. 2005-249632 (corresponding to US 2005/0195690 A1), the demodulated signal is binarized at a predetermined sampling interval (50 ms) to obtain TCO data and a list of data groups (20 samples) in the form of binary bit strings is obtained every one second.

The apparatus disclosed in Jpn. Pat. Appln. KOKAI Publication No. 2005-249632 compares the bit string with each of the templates of a binary bit string indicating a position marker code P, a binary bit string indicating a code 1, and a binary bit string indicating a code 0, calculates a correlation therebetween, and determines to which of the codes P, 1, and 0 the bit string corresponds, based on the correlation.

In the technique disclosed in Jpn. Pat. Appln. KOKAI Publication No. 2005-249632, the TCO data, which is a binary bit string, is acquired and matched with the template. When the field intensity is weak or a large amount of noise is mixed with the demodulated signal, many errors are included in the acquired TCO data. Therefore, it is necessary to provide a filter which removes noise from the demodulated signal or to finely adjust the threshold of an AD converter, in order to improve the quality of the TCO data.

JPn. Pat. Appln. KOKAI Publication No. 2009-216544 (corresponding to US 2009/0231963 A1) discloses a technology for generating input waveform data corresponding to one frame (60 seconds), generating predicted waveform data which has the same data length as the input waveform data and is associated with a current time conforming to a time (a base time) based on an internal clock, comparing a sample value of the input waveform data with a corresponding sample value of the predicted waveform data, and detecting the number of errors. According to the technology in JPn. Pat. Appln. KOKAI No. 2009-216544 (corresponding to US 2009/0231963 A1), the predicted waveform data is shifted by one bit (a sample value at the end of the data becomes a sample value at the head of the same), and comparison between the sample value of the input waveform data and a new corresponding sample value of the shifted predicted waveform data is repeated. The processing is repeated for 60 times, predicted waveform data having the smallest number of errors is found based on the numbers of errors in the respective pieces of predicted waveform data, and an error of the base time is acquired based on a shift number of the found predicted waveform data.

The technology in JPn. Pat. Appln. KOKAI No. 2009-216544 (corresponding to US 2009/0231963 A1) requires input waveform data corresponding to 60 seconds. Additionally, it is required to generate 60 types of predicted waveform data by a shifting operation and to compare the sample value of the input waveform data with the sample value of the predicted waveform data. Therefore, there is a problem that the acquisition of the input waveform data and the comparison of the sample values require a processing time. Further, since an electric wave receiving status is not necessarily constant, reducing a reception time for the standard time radio wave is desired to acquire the input waveform data.

BRIEF SUMMARY OF THE INVENTION

An object of the invention is to provide a time information acquisition apparatus that can assuredly acquire a current time based on the standard time radio wave in a short time and the radio wave timepiece.

According to an embodiment of the present invention, a time information acquisition apparatus comprises an input waveform data pattern generator configured to sample a standard time radio wave signal including a time code indicative of time information from a second head position in a predetermined sampling cycle in order to generate an input waveform data pattern having one or more unit time lengths, wherein a sample value at a sample point in the input waveform data pattern is one of a first value indicative of a low level and a second value indicative of a high level; a predicted waveform data pattern generator configured to generate predicted waveform data patterns each having the one or more unit time lengths, represents a string of codes based on a base time measured by an internal timer, and has a head position indicative of the base time or a time preceding or succeeding to the base time by a predetermined number of seconds, wherein a sample value at a sample point in the predicted waveform data pattern is one of the first value and the second value; an error detector configured to detect non-coincidence between the sample value of the input waveform data pattern and the sample value of each of the predicted waveform data patterns in order to acquire a number of errors indicative of a number of non-coincidences of each of the plurality of predicted waveform data patterns; a current time correction module configured to correct the base time based on the head position of the predicted waveform data pattern indicative of a minimum value of the number of errors; and a controller configured to determine the predetermined number of seconds based on a time difference between the base time corrected by the current time correction module and a current base time and a predetermined timer accuracy in order to determine the number of predicted waveform data patterns to be generated.

According to another embodiment of the present invention, a time information acquisition apparatus comprises an input waveform data pattern generator configured to sample a standard time radio wave signal including a time code indicative of time information from a second head position in a predetermined sampling cycle in order to generate an input waveform data pattern having one or more unit time lengths, wherein a sample value at a sample point in the input waveform data pattern is one of a first value indicative of a low level and a second value indicative of a high level, and the sample value is a value in a section between change points of a value of a code included in the standard time radio wave; a predicted waveform data pattern generator configured to generate predicted waveform data patterns each having the one or more unit time lengths, represents a string of codes based on a base time measured by an internal timer, and has a head position indicative of the base time or a time preceding or succeeding to the base time by a predetermined number of seconds, wherein a sample value at a sample point in the predicted waveform data pattern is one of the first value and the second value, a number of samples of the predicted waveform data patterns is equals to a number of samples of the input waveform data pattern; an error detector configured to detect non-coincidence between the sample value of the input waveform data pattern and the sample value of each of the predicted waveform data patterns in order to acquire a number of errors indicative of a number of non-coincidences of each of the plurality of predicted waveform data patterns for each of the sections of each of the plurality of predicted waveform data patterns; an effective value calculator configured to calculate a number of effective errors, which is a number of errors concerning an effective section, in the number of errors for each of the sections; and a current time correction module configured to correct the base time based on the head position of the predicted waveform data pattern indicative of a minimum value of the number of errors.

According to another embodiment of the present invention, a radio wave timepiece comprises the time information acquisition apparatus described above; an internal timer configured to measure a current time by using an internal clock; and a time display device configured to display the current time measured by the internal timer or the current time corrected by the current time correction module.

Additional objects and advantages of the present invention will be set forth in the description which follows, and in part will be obvious from the description, or may be learned by practice of the present invention.

The objects and advantages of the present invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the present invention and, together with the general description given above and the detailed description of the embodiments given below, serve to explain the principles of the present invention.

FIG. 6A, FIG. 6B, FIG. 6C, FIG. 6D, FIG. 6E, and FIG. 6F are views for explaining input waveform data, an input waveform data pattern, and a plurality of predicted waveform data patterns according to the embodiment.

FIG. 8A, FIG. 8B, and FIG. 8C are views showing respective codes included in the standard time radio wave signal conforming to the JJY standard in more detail.

FIG. 9 is a view showing an example of an allowable maximum BER table according to the embodiment.

FIG. 19 is a view showing an example of a reliability judgment table according to a modification of the invention.

DETAILED DESCRIPTION OF THE INVENTION

Hereinafter, the first embodiment of the invention will be described with reference to the accompanying drawings. According to the first embodiment, a time information acquisition apparatus is provided in a radio wave timepiece that receives a standard time radio wave in a long wavelength band, detects the signal thereof, extracts a code string indicating a time code in the signal, and corrects time based on the code string.

In recent years, for example, in Japan, Germany, England, and Switzerland, a standard time radio wave is transmitted from a predetermined transmitting station. For example, transmitting stations in Fukushima and Saga prefectures in Japan transmit amplitude-modulated standard time radio waves of 40 kHz and 60 kHz, respectively. The standard time radio wave includes a code string forming a time code indicating the date and time and is transmitted with a period of 60 seconds. Since one code has a unit time length (one second), one period may include 60 codes.

Figure 1:
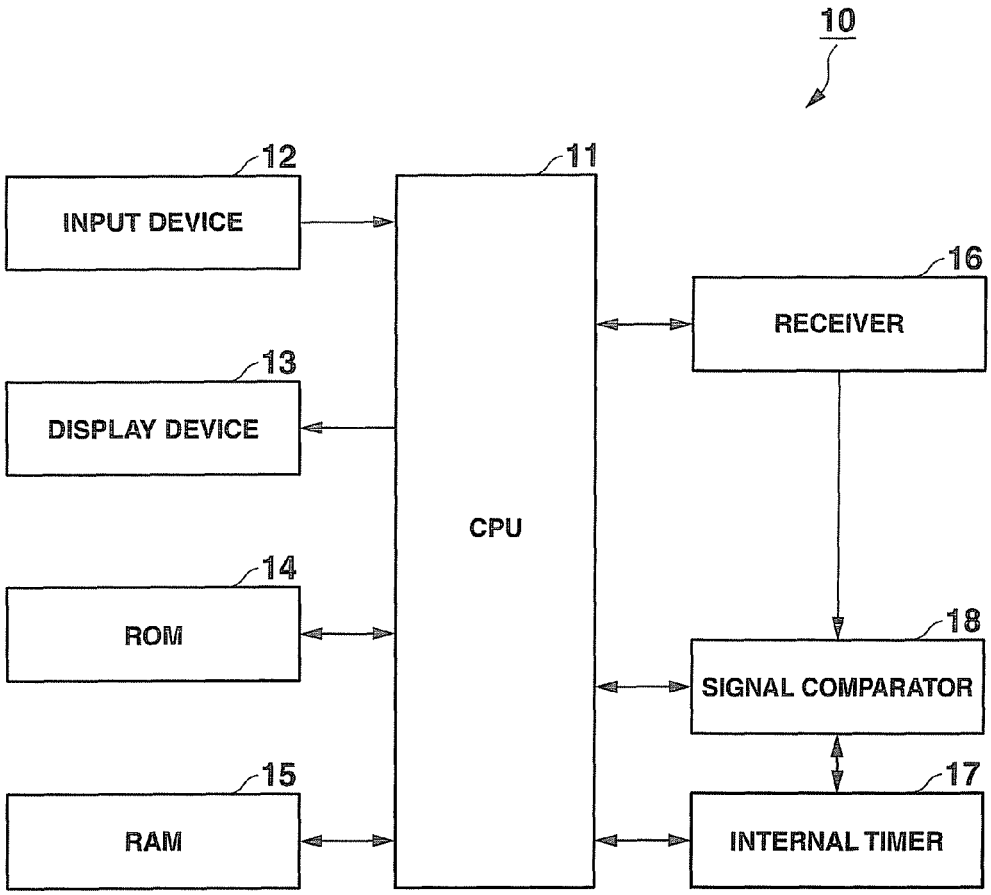
FIG. 1 is a block diagram showing a configuration of a radio wave timepiece according to a first embodiment of the invention.

FIG. 1 is a block diagram illustrating the structure of a radio wave timepiece according to the first embodiment. As shown in FIG. 1, a radio wave timepiece 10 includes a CPU 11, an input device 12, a display device 13, a ROM 14, a RAM 15, a receiver 16, an internal timer 17, and a signal comparator 18.

The CPU 11 reads a program stored in the ROM 14 at predetermined timing or in response to an operation signal input from the input device 12, expands the read program in the RAM 15, and transmits instructions or data to each unit or device of the radio wave timepiece 10 based on the program. Specifically, the receiver 16 is controlled every predetermined periods to receive the standard time radio wave, a string of codes included in the standard time radio wave is specified from digital data based on a signal obtained from the receiver 16, and processing of transferring a base time obtained by the internal timer 17 to the display device 13 or processing of correcting a base time BT is executed based on this string of codes.

In the embodiment, as will be described later, the base time BT which is a time obtained by the internal timer 17 is utilized to specify a processing start time NOW, a plurality of predicted waveform data patterns that have as a start time a clock time which is ahead of or behind the processing start time NOW by a predetermined time period and have a unit time length equal to or above one are generated, and the plurality of predicted waveform data patterns are compared with an input waveform data pattern generated from the received waveform, respectively.

As a result of the comparison, codes included in the received signal are specified, and a difference between the base time BT and a time based on the received signal is calculated, thereby correcting the base time BT in the internal timer 17.

The input device 12 includes switches configured to instruct the radio wave timepiece 10 to perform various kinds of functions. When a switch is operated, a corresponding operation signal is output to the CPU 11. The display device 13 includes a liquid crystal panel, an analog pointer mechanism controlled by the CPU 11, and a dial and displays the current time measured by the internal timer 17. The ROM 14 stores, for example, a system program or an application program configured to operate the radio wave timepiece 10 and to implement a predetermined function. The programs configured to implement the predetermined function also include a program configured to control the signal comparator 18 in order to perform a process of detecting a second pulse position, which will be described below. The RAM 15 is used as a work area of the CPU 11 and temporarily stores, for example, the program or data read from the ROM 14 and data processed by the CPU 11.

The receiver 16 includes, for example, an antenna circuit or a detector. The receiver 16 obtains a demodulated signal from the standard time radio wave received by the antenna circuit and outputs the signal to the signal comparator 18. The internal timer 17 includes an oscillator. The internal timer 17 counts clock signals output from the oscillator to measure the current time and outputs data of the current time to the CPU 11.

Figure 2:
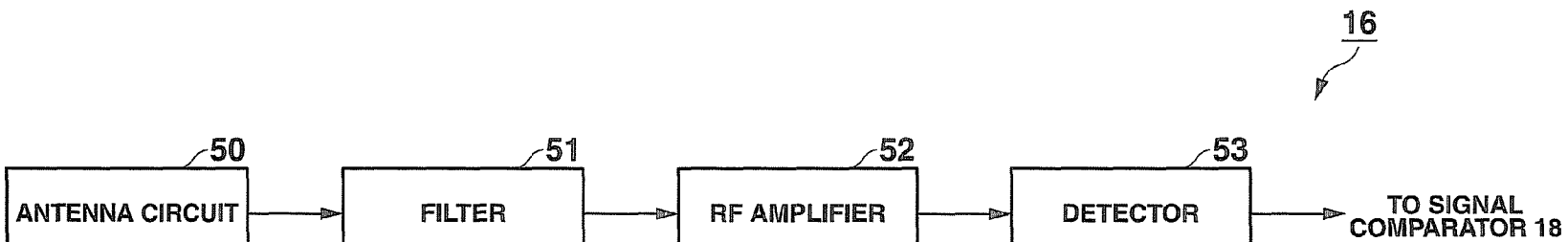
FIG. 2 is a block diagram showing a structural example of a receiver 16 according to the first embodiment.

FIG. 2 is a block diagram illustrating an example of the structure of the receiver 16 according to the first embodiment. As shown in FIG. 2, the receiver 16 comprises an antenna circuit 50 that receives a standard time radio wave, a filter 51 that removes a noise from the signal of the standard time radio wave (standard time radio wave signal) received by the antenna circuit 50, an RF amplifier 52 that amplifies a high frequency signal, which is the output of the filter 51, and a detector 53 that detects a signal output from the RF amplifier 52 and demodulates the standard time radio wave signal. The signal demodulated by the detector 53 is output to the signal comparator 18.

Figure 3:
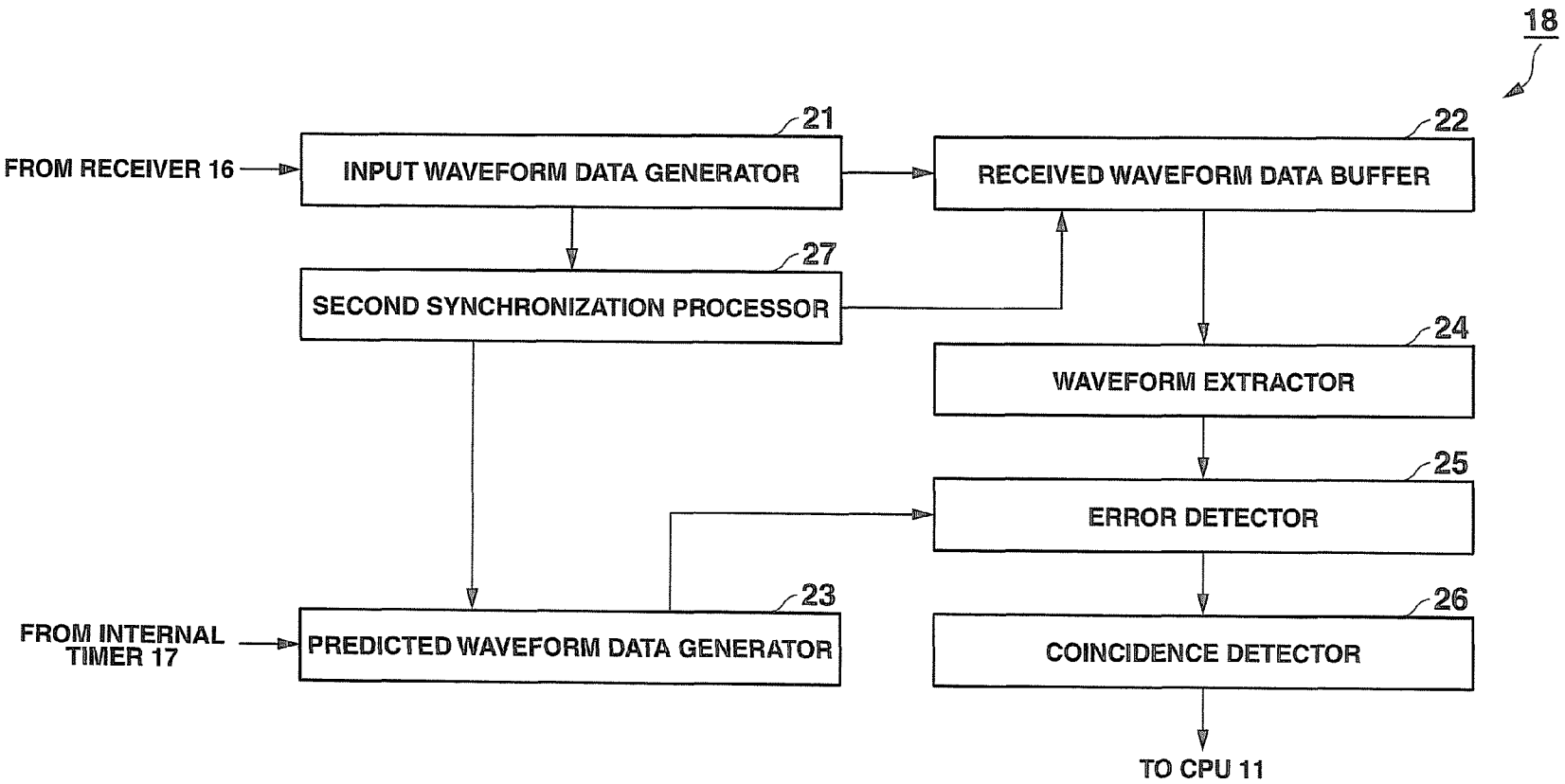
FIG. 3 is a block diagram showing "e" configuration of a signal comparator 18 according to the first embodiment.

FIG. 3 is a block diagram illustrating the structure of the signal comparator 18 according to the first embodiment. As shown in FIG. 3, the signal comparator 18 includes an input waveform data generator (input waveform data pattern generator) 21, a received waveform data buffer 22, a predicted waveform data generator 23, a waveform extractor (input waveform data pattern extractor) 24, an error detector 25, a coincidence detector (current time correction circuit) 26, and a second synchronization processor 27.

The input waveform data generator 21 converts the signal output from the receiver 16 into digital data having any one of plural values "0" and "1" at predetermined sampling intervals and outputs the converted digital data. For example, the sampling interval is 50 ms and data of 20 samples per second may be acquired. The value of the digital data according to the first embodiment will be described below. The received waveform data buffer 22 sequentially stores data generated by the input waveform data generator 21. The received waveform data buffer 22 may store data (e.g., data of 20 seconds) having a plurality of unit time lengths (1 unit time: one second). When new data is stored, the old data is erased in chronological order.

In the first embodiment, data that is generated by the input waveform data generator 21 and corresponds to one code is called the input waveform data, and a value of this data is called the sample value. Data of a plurality of codes acquired over a plurality of seconds is called an input waveform data pattern. With respect to the predicted waveform data generator 23 described below, data corresponding to one code is called predicted waveform data, and data of a plurality of codes is called a predicted waveform data pattern.

The predicted waveform data generator 23 generates a plurality of predicted waveform data patterns which are to be compared with an input waveform data pattern. The plurality of predicted waveform data pattern will be described later. The waveform extractor 24 extracts an input waveform data pattern having the same time length as a time length of the predicted waveform data pattern from the received waveform data buffer 22.

The second synchronization processor 27 detects a second head position in input waveform data generated by the input waveform data generator 21 by, e.g., a known conventional technique. For example, in the standard time radio wave conforming to JJY, as shown in FIG. 8A to FIG. 8C, all codes have rising edges at a second head position. Therefore, the second head position can be detected by detecting a rising edge of this signal.

The error detector 25 calculates the number of errors indicative of non-coincidence of each of the plurality of predicted waveform data patterns and a value of the input waveform data pattern. As described above, the input waveform data pattern has the sample value D(n) of the input waveform data for each second. The predicted waveform data pattern likewise has a sample value P(n) of the predicted waveform data for each second. Therefore, when the sample value of the input waveform data is compared with the sample value of the corresponding predicted waveform data and the number of errors is counted up by one in response to a non-coincidence result, the number of errors can be calculated.

The coincidence detector 26 calculates a bit error rate (BER) based on the number of errors for each of the plurality of predicted waveform data patterns and specifies the predicted waveform data pattern that coincides with the input waveform data pattern based on the calculated BER.

Figure 4:
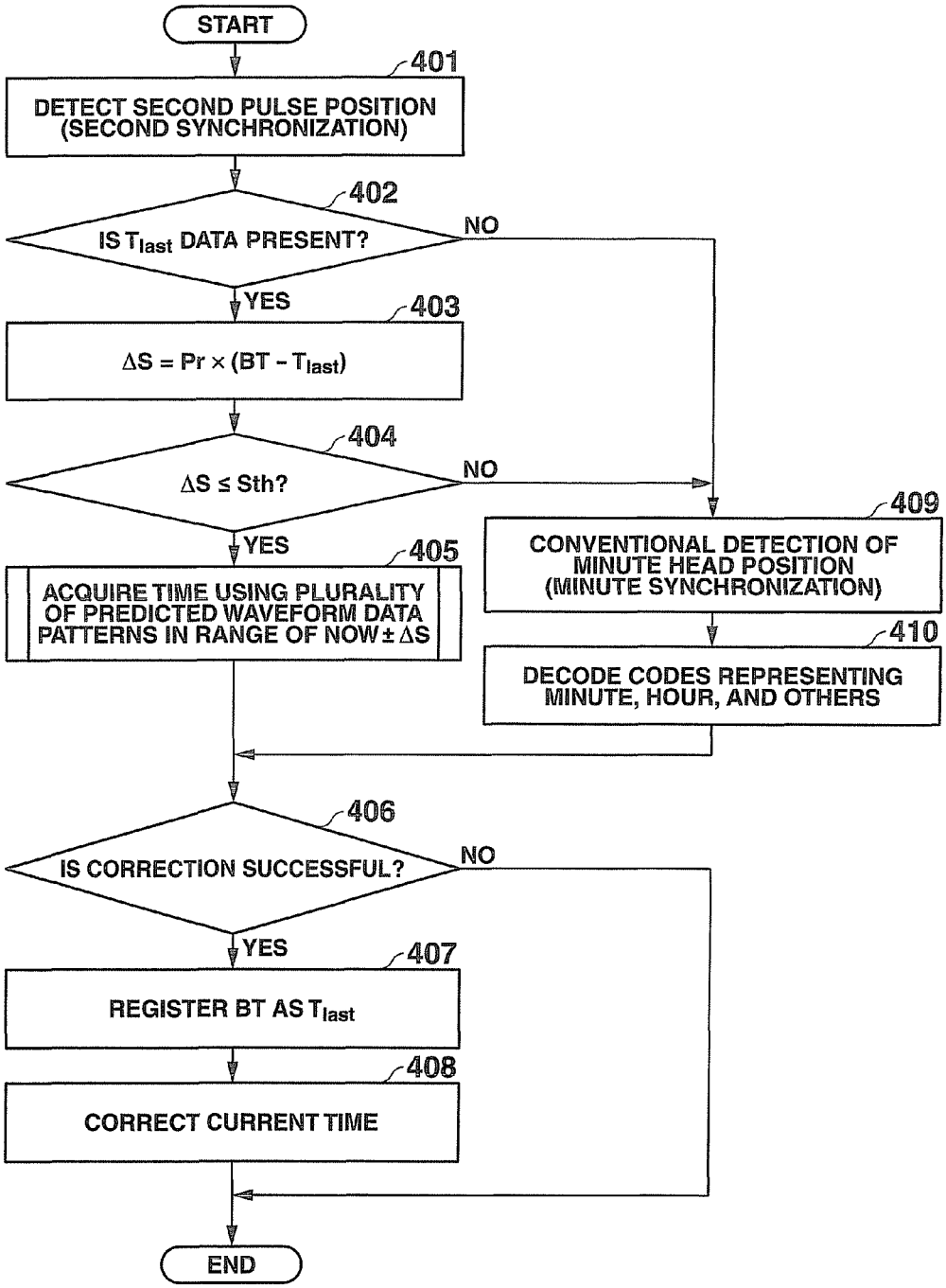
FIG. 4 is a flowchart showing an outline of processing executed in a radio wave timepiece 10 according to the embodiment.

FIG. 4 is a flowchart showing an outline of processing executed by the radio wave timepiece 10 according to the embodiment. The processing shown in FIG. 4 is mainly executed by the CPU 11 and the signal comparator 18 based on an instruction from the CPU 11. As shown in FIG. 4, the CPU 11 and the signal comparator 18 detect a second pulse position (Step 401). Processing of detecting the second pulse position is also called the second synchronization.

The second synchronization is realized by the second synchronization processor 27 of the signal comparator 18 based on, e.g., a known conventional technique. A second head position in the input waveform data is specified by the second synchronization, and a time difference Δt between a head of the input waveform data and the specified second head position can be obtained.

Figure 7A:
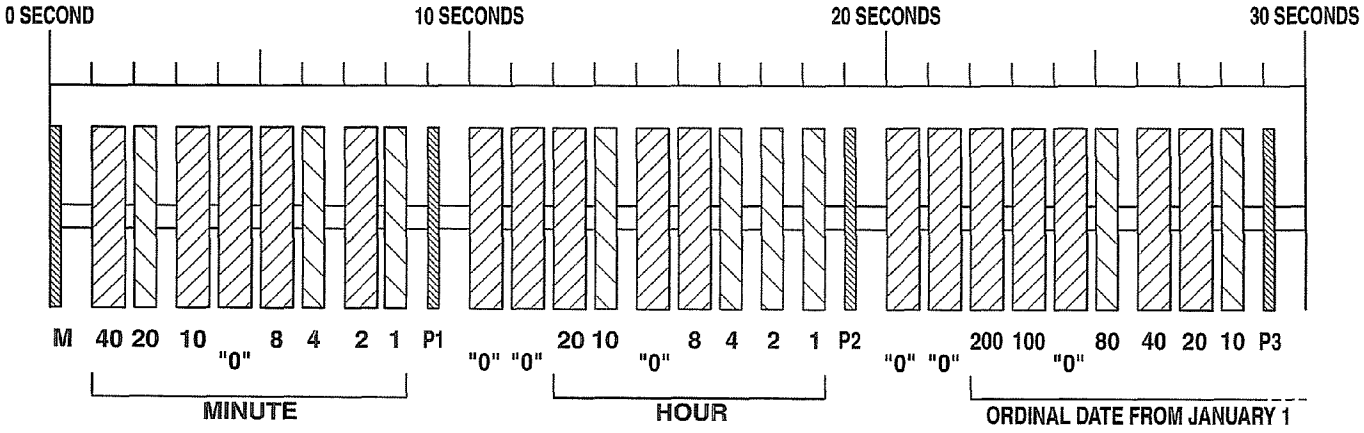
FIG. 7A and FIG. 7B are views showing an example of a standard time radio wave signal conforming to a JJY standard.
Figure 7B:
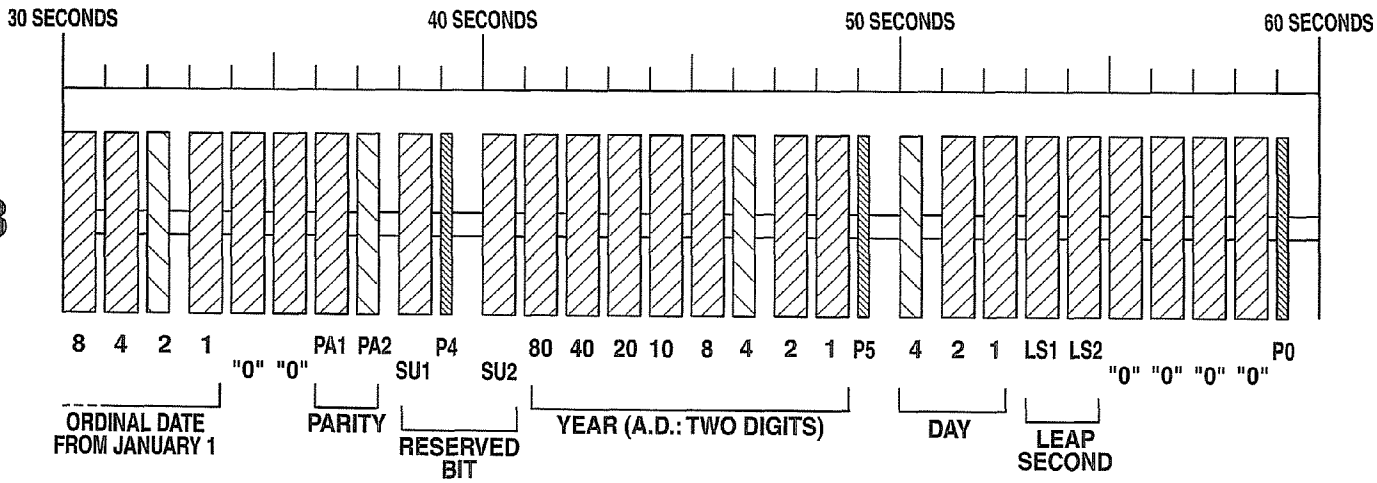

FIG. 7A and FIG. 7B are views showing an example of the standard time radio wave signal conforming to the JJY standard. As shown in FIG. 7A and FIG. 7B, in the standard time radio wave signal conforming to the JJY standard, codes of the JJY are transmitted in a predetermined order. In the standard time radio wave signal of the JJY, a position marker code P, a code "0", and a code "1" having a unit time length of one second are continuous. In the standard time radio wave, a period of 60 seconds is determined as one frame, and one frame includes 60 codes. Further, in the standard time radio wave, positions markers P1, P2, . . . or a marker M arrives every 10 seconds, and detecting a portion where the position marker P0 arranged at an end of a frame is continuous with the marker M arranged at a head of the frame enables finding a head of each frame that arrives every 60 seconds, i.e., a head position of a minute. The second synchronization means finding a head position of any one of the 60 codes.

Each of FIG. 8A to FIG. 8C is a view showing each code included in the standard time radio wave signal conforming to the JJY in more detail. As shown in FIG. 8A to FIG. 8C, in JJY, the position marker code P, the code "0", and the code "1" having the unit time length of one second are included. In the code "0", a level is set to a high level (value "1") in a section of 800 ms at the head, and it is changed to a low level (value "0") in a section of remaining 200 ms.

In the code "1", a level is set to the high level (value "1") in a section of first 500 ms, and it is changed to the low level (value "0") in a section of remaining 50 ms. Furthermore, in the position marker P, a level is set to the high level (value "1") in a section of first 200 ms, and it is changed to the low level (value "0") in a section of remaining 800 ms.

FIG. 6A is a view for explaining the input waveform data and the input waveform data pattern according to the embodiment. FIG. 6B to FIG. 6F are views for explaining the plurality of predicted waveform data patterns. FIG. 6A shows input waveform data 600 in which the processing start time NOW based on the base time BT which is a clock time acquired by the internal timer 17 is provided at a data head. This data is indicative of a situation that a second head position is behind the processing start time NOW based on the base time BT by Δt on a time axis when the second synchronization processor 27 executes the second synchronization. Thereafter, in the input waveform data, NOW+Δt and a position apart from NOW+Δt in seconds are determined as references, and data is extracted. The time NOW+Δt will be referred to as a code head time hereinafter. The base time BT means a time measured by the internal timer 17 in the radio wave timepiece 10 according to the embodiment. Moreover, the processing start time NOW is a time at which reception of the standard time radio wave based on the base time BT is started.

In FIG. 4, when the second synchronization (Step 401) is terminated, the CPU 11 and the signal comparator 18 determine whether a last corrected time $T_{last}$ acquired by previous processing and stored in a predetermined region in the RAM 15 is present (Step 402). It is to be noted that $T_{last}$ is reset when the entire radio wave timepiece 10 is reset or when a user operates the input device 12 to change a time in the internal timer 17. Therefore, in such a case, a result of the determination at Step 402 is No.

When a result of the determination at Step 402 is Yes, the CPU 11 and the signal comparator 18 use the following Expression to calculate an estimated maximum error ΔS which is an error estimated based on an internal clock accuracy Pr in the radio wave timepiece 10 (Step 403).

$$\Delta S = Pr \times (BT - T_{last})$$

$(BT - T_{last})$ represents a period from correction of the time in the previous processing to the time BT measured by the internal timer 17, i.e., a period that time correction is not carried out. In a case where Pr is a value (e.g., 15 seconds) corresponding to a lunar inequality ±15 seconds, if $(BT-T_{last})$ is 30 days, ΔS is 15 seconds.

Then, whether the estimated maximum error ΔS is larger than a threshold value Sth is determined (Step 404). In the embodiment, if the radio wave timepiece 10 has the lunar inequality ±15 seconds and a period where the time correction is not performed is within 30 days (i.e., Sth corresponds to 30 days), time acquisition processing using the plurality of predicted waveform data patterns according to the embodiment is executed (Step 405). If ΔS is the number of seconds, 2ΔS+1 predicted waveform data patterns are generated.

Figure 5:
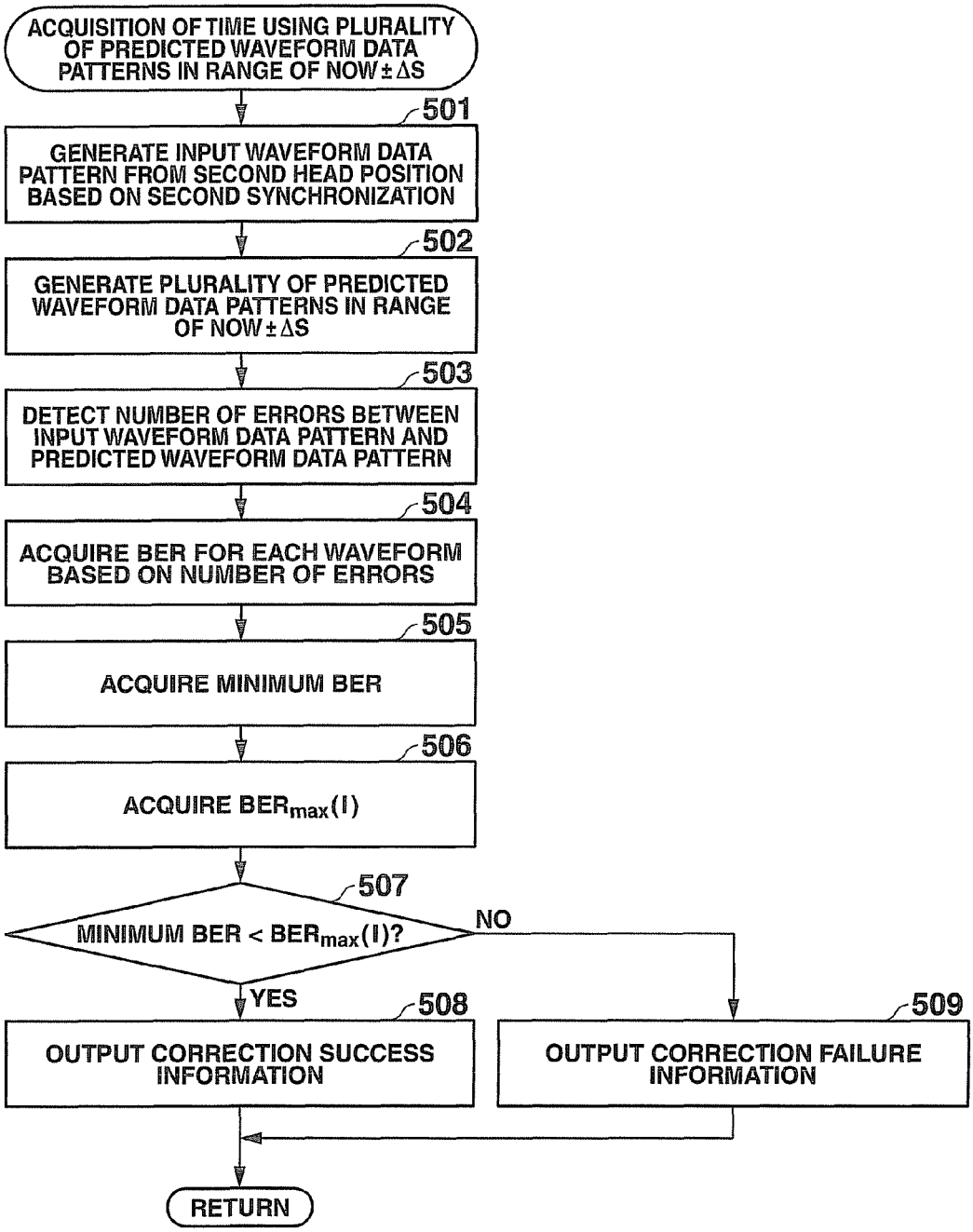
FIG. 5 is a flowchart showing Step 405 according to the embodiment in more detail.

FIG. 5 is a flowchart showing Step 405 according to the embodiment in more detail. As shown in FIG. 5, the waveform extractor 24 in the signal comparator 18 reads out the input waveform data from the received waveform data buffer 22 and generates an input waveform data pattern DP with a time length having a predetermined number of seconds from the second head position NOW+Δt based on the second synchronization. In an example shown in FIG. 6A, an input waveform data pattern DP (see reference numeral 602) corresponding to 5 seconds of sample values D(0) to D(4) in the input waveform data is shown. The number of the sample values D(n) (n=0 to N−1) is determined by, e.g., a reception intensity of the standard time radio wave received by the receiver 16. For example, assuming that N−1=approximately 20 is a minimum value, the CPU 11 can determine the number of the sample values wherein the number of the sample values increases as the reception intensity of the standard time radio wave decreases.

In FIG. 6A, the sample values D(0) to D(4) start from times NOW+Δt, NOW+Δt+1, NOW+Δt+2, NOW+Δt+3, and NOW+Δt+4, respectively, and each of these values includes a value indicative of one code "0" or "1".

Then, the predicted waveform data generator 23 generates a plurality of predicted waveform data patterns having start times deviated in the range of ΔS around the processing start time NOW based on the base time (Step 502). That is, the predicted waveform data generator 23 generates the plurality of predicted waveform data patterns that have NOW±ΔS at the heads of the respective patterns and have the same time length as that of the input waveform data pattern. FIG. 6B to FIG. 6F show five predicted data patterns of ΔS=−2 to 2 seconds.

A first predicted waveform data pattern PP(0) to a fifth predicted waveform data pattern PP(4) (see reference numerals 610 to 614) use NOW−2, NOW−1, NOW, NOW+1, and NOW+2 as pattern start times, respectively. For example, the first predicted waveform data pattern PP(0) has a sample value P(−2) associated with a code at the time NOW−2, a sample value P(−1) associated with a code at the time NOW−1, a sample value P(0) associated with a code at the time NOW, a sample value P(1) associated with a code at the time NOW+1, and a sample value P(2) associated with a code at the time NOW+2.

Subsequently, the error detector 25 compares the input waveform data pattern DP with each of the plurality of predicted waveform data patterns in sample values of corresponding codes to calculate the number of errors corresponding to non-coincidences of the sample values (Step 503). In the example shown in FIG. 6A to FIG. 6F, the input waveform data pattern DP and each of the predicted waveform data patterns PP(0) to PP(4) are compared.

For example, a comparison between the input waveform data pattern DP and the first predicted waveform data pattern PP(0) will now be described. In this case, the associated sample values, i.e., D(0) and P(−2), D(1) and P(−1), D(2) and P(0), D(3) and P(1), and D(4) and P(2) are compared, respectively. Furthermore, in a comparison between the input waveform data pattern DP and the second predicted waveform data pattern PP(1), D(0) and P(−1), D(1) and P(0), D(2) and P(1), D(3) and P(2), and D(4) and P(3) are compared, respectively.

If both the pieces of associated code data coincide with each other as a result of the comparison, the number of errors is 0. If both the pieces of associated code data do not coincide with each other, the number of errors is 1. The error detector 25 calculates a sum total of the number of errors in all the pieces of associated code data.

Then, the coincidence detector 26 calculates a bit error rate (BER) associated with each of the plurality of predicted waveform data patterns based on the number of errors (a total number of errors) calculated with respect to each of the plurality of predicted waveform data patterns (Step 504). For example, the bit error rate (BER) can be obtained by calculating (the sum total of the number of errors)/(the number of samples I of the input waveform data pattern). The coincidence detector 26 finds a minimum bit error rate (a minimum BER) in the bit error rates BER (Step 505). Then, the coincidence detector 26 acquires an allowable maximum bit error rate $BER_{max}(I)$ determined by the number of samples (I) of the input waveform data pattern (Step 506) and determines whether the minimum BER is smaller than the allowable maximum bit error rate $BER_{max}(I)$ (Step 507).

The bit error rate will now be described. The allowable maximum bit error rate $BER_{max}(I)$ increases as the number of pieces of data to be received (the number of samples of the input waveform data pattern) increases (i.e., a data length becomes long). Namely, reliability of coincidence of data is enhanced even though the error rate increases as the data length becomes long.

In a coincidence detection of the input waveform data pattern and each predicted waveform data pattern, to avoid erroneous coincidence detection, a probability of accidental coincidence of data (an error rate) must be approximated to zero as much as possible.

Assuming that the radio wave timepiece 10 receives the standard time radio wave 24 times a day and the number of errors is just one even if this reception is repeated for 100 years, setting a probability of non-coincidence to approximately $1/10^6=1/(24\times365\times100)$ can suffice. In regard to the probability of non-coincidence, $1/10^8$ is considered to be allowed as a target value.

If sample values "0" and "1" have the same probability of occurrence, a probability of accidental coincidence of the input waveform data pattern (the sample value "0" or "1") of N bits (N samples) with the predicted waveform data pattern is as follows.

P0=P1=0.5 (P0: a probability of occurrence of "0", P1: a probability of occurrence of "1")

Assuming that a probability of non-coincidence is $P0^N<(1/10^8)$, N≧27 is achieved. That is, when data of 27 bits is received, and all N bits coincide with the predicted waveform data pattern, the reliability can be obtained. This means that the reliability cannot be obtained if the number of bits N is smaller than 27.

In reality, the sample values "0" and "1" may not have the same probability of occurrence. That is, the probability of occurrence is biased like P0>P1. In such a case, when the same calculation as that described above is performed, P0>P1 is achieved. A numerical value with the highest probability of occurrence has all N bits being "0" and has the maximum probability of non-coincidence. Further, its probability of occurrence is $P0^N$.

Assuming that bias of a probability of occurrence of each code is P0=0.55 and P1=0.45, when $P0^N<(1/10^8)$ is solved, N 31 is achieved. That is, this means that, as compared with the example of P0=P1 (N=27), the reliability cannot be obtained unless 4 more bits (=31−27) are received.

The example where all the N bits coincide has been described. However, in case of a weak electric field, coincidence of all bits does not often occur because of an influence of noise. Even in imperfect coincidence with some non-coincident bits, if even one solution whose occurrence rate is $1/10^8$ or below is present, this solution can be determined as coincidence.

Assuming that the input waveform data pattern has N bits (N samples) and the number of samples that do not coincide with the predicted waveform data pattern (the number of error bits) is e, there is one pattern that the input waveform data pattern perfectly coincides with the predicted waveform data pattern and there are COMBIN(N,e) patterns having "e" non-coincident codes in a string of codes 0/1 in data. It is to be noted that COMBIN(N,e) is the number of combinations for selecting "e" from N.

If N is sufficiently larger than "e" (i.e., e<<N), it can be considered that a probability of occurrence of each imperfect coincidence is substantially equal to a probability of occurrence of perfect coincidence. When P0>P1 is achieved, the highest probability of occurrence in all imperfect non-coincidence patterns is $P0^N \times \mathrm{COMBIN}(N, e)$. If this value is equal to or smaller than $1/10^8$, even an imperfect coincidence pattern can be regarded as a coincidence pattern. This situation can be represented by the following expression.

$$P0^N \times \mathrm{COMBIN}(N,e) < 1/10^8$$

When e=1, solving this expression in regard to N can obtain the following expression.

$$N \geqq 40$$

Likewise, when an arithmetic operation is performed with respect to e=10, 21, 31, and 42, the following results can be obtained.

$$e=10,\ N \geqq 80,\ \mathrm{BER}=0.125$$

$$e=21,\ N \geqq 120,\ \mathrm{BER}=0.175$$

$$e=31,\ N \geqq 160,\ \mathrm{BER}=0.194$$

$$e=42,\ N \geqq 200,\ \mathrm{BER}=0.21$$

It can be understood that the number of allowable error bits required for assuring reliability changes in accordance with the number of received bits N.

In general, since "e" increases as N rises, when such characteristics are utilized, a time can be highly possibly corrected by prolonging a reception time and increasing the number of bits (the number of sample values) even though the time cannot be corrected due to a poor BER.

In the embodiment, for example, such an allowable maximum BER table as shown in FIG. 9 is provided in accordance with each range for the number of samples in the input waveform data. The coincidence detector 26 can acquire a corresponding $\mathrm{BER}_{max}(I)$ in accordance with the number of samples I in the input waveform data pattern (Step 506).

The coincidence detector 26 compares the minimum BER acquired at Step 505 with $\mathrm{BER}_{max}(I)$ acquired at Step 506 to determine whether the minimum $\mathrm{BER}<\mathrm{BER}_{max}(I)$ is achieved (Step 507). If a result of the determination is Yes at Step 507, the coincidence detector 26 outputs information indicative of success in correction as correction information and information of the predicted waveform data pattern indicative of the minimum BER (information indicative of deviation from BT) to the CPU 11 (Step 508).

A deviation time ΔT from the base time BT is expressed as follows.

$$\Delta T = BT + s - (BT + \Delta t) = s - \Delta t$$

Here, "s" is a time of deviation from the base time BT in code data at the head of the predicted waveform data pattern.

If a result of the determination at Step 507 is No, the coincidence detector 26 outputs information indicative of failure in correction as the correction information to the CPU 11 (Step 509). When the CPU 11 has received the correction information indicative of success in correction (Yes at Step 406), it stores the base time BT as a last corrected time $T_{last}$ in the RAM 15 (Step 407). Furthermore, the base time BT is corrected based on the deviation time ΔT from the base time BT (Step 408). At Step 408, the CPU 11 corrects the time in the internal timer 17 and displays a corrected current time in the display device 13.

When a result of the determination at Step 402 is No or when a result of the determination at Step 404 is No, the CPU 11 detects a minute head position by a conventional known technique (Step 409), specifies a code for each second from the minute head position, and decodes a minute, an hour, a day, and others to obtain a current time (Step 410).

According to the embodiment, the waveform extractor 24 samples a signal of the standard electric wave from the second head position in a predetermined sampling cycle, and generates one input waveform data pattern in which a sample value at each sample point takes either a first value indicative of a low level or a second value indicative of a high level and which has a unit time length of one or above.

Furthermore, the predicted waveform data generator 23 generates a plurality of predicted waveform data patterns in which the sample value of each sample point can take either the first value or the second value and has the same time length as the input waveform data pattern, each sample value represents a string of codes based on the base time BT acquired by the internal timer 17, and a head position of each code string corresponds to the base time BT and a time deviated by predetermined seconds (±ΔS) around the base time.

The error detector 25 determines coincidence/non-coincidence of the sample value of the input waveform data pattern and the sample value of each predicted waveform data pattern, counts the number of errors indicative of non-coincidence, and acquires the number of errors in regard to each of the plurality of predicted waveform data patterns. The coincidence detector 26 calculates an error of the base time BT based on the head position of the predicted waveform data pattern indicative of the number of errors which is a minimum value. The CPU 11 determines a predetermined number of seconds and also determines the number of predicted waveform data patterns to be generated based on a time difference between a time obtained by correcting the base time and the current base time and a predetermined timer accuracy. Therefore, according to the embodiment, the number of predicted waveform data patterns is determined based on a time interval from a previous correction, and a processing time can be prevented from being increased due to generation of many predicted waveform data patterns.

In the embodiment, the input waveform data pattern to be generated has one sample value in accordance with each code. In acquisition of this sample value, the input waveform data generator 21 and the waveform extractor 24 acquire data values at a plurality of temporally different positions in accordance with each code, and determine the sample value of this code based on the plurality of data values. As a result, a data length of the input waveform data pattern can be reduced, thereby further shortening the processing time.

In the embodiment, when the minimum value of the number of errors is smaller than the allowable maximum number of errors predetermined in accordance with the number of samples, the coincidence detector 26 acquires an error of the base time based on the head position of the predicted waveform data pattern indicative of the number of errors which is the minimum value. As a result, a possibility of erroneous detection can be considerably reduced.

In the embodiment, the CPU 11 determines the number of sample values in such a manner that this number increases as a reception intensity of the received standard time radio wave decreases, and the input waveform data pattern is generated in accordance with the determined number of sample values. Therefore, the input waveform data pattern and the predicted waveform data patterns each having an optimum data length associated with the reception intensity can be generated.

In the embodiment, the CPU 11 calculates an estimated maximum error ΔS based on the time difference and the timer accuracy, and the predicted waveform data generator 23 generates the plurality of predicted waveform data patterns having head positions falling within the maximum error range (±ΔS). As a result, the number of the predicted waveform data patterns can be suppressed to the minimum while maintaining the good accuracy.

Other embodiments of the time information acquisition apparatus according to the present invention will be described. The same portions as those of the first embodiment will be indicated in the same reference numerals and their detailed description will be omitted.

A second embodiment of the present invention will now be described. In the first embodiment, the sample value D(n) of the input waveform data indicative of one value is obtained in accordance with each code (every second), and the input waveform data pattern corresponding to N seconds is generated (see FIG. 6A). The predicted waveform data pattern also includes the sample values P(n) for each second that correspond to N seconds like the input waveform data pattern. In the second embodiment, one code is divided into a plurality of sections (4 sections) to acquire a value of each section, thereby obtaining input waveform data corresponding to one second. That is, the input waveform data corresponding to one second includes 4 sample values. Furthermore, in comparison between the input waveform data in an input waveform data pattern and predicted waveform data in a predicted waveform data pattern and detection of the number of errors, a comparison result of sample values in a specific section alone is used as an effective value.

Figure 10:
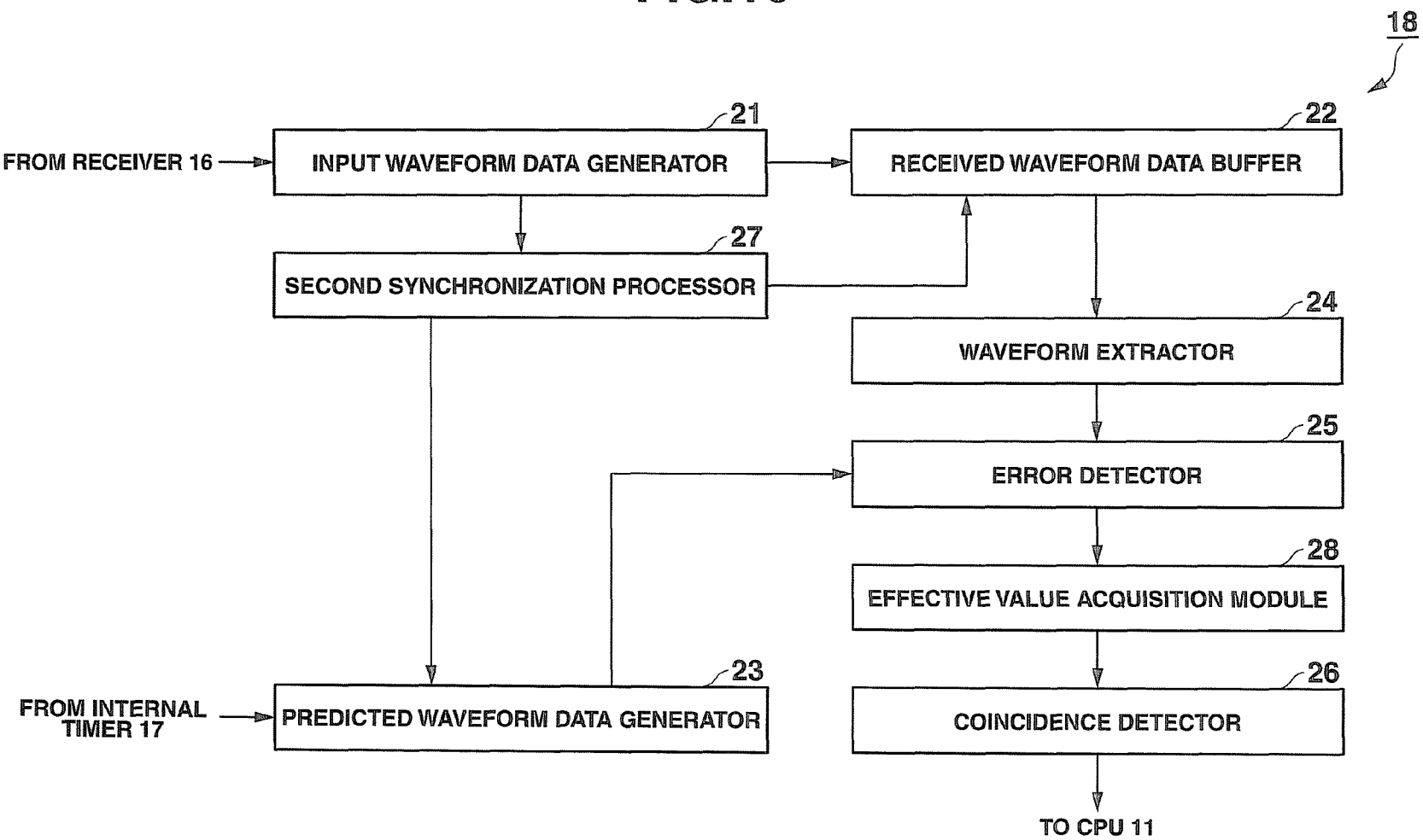
FIG. 10 is a block diagram sowing a configuration of a signal comparator 18 according to a second embodiment.

FIG. 10 is a block diagram showing a configuration of the signal comparator 18 according to the second embodiment. As shown in FIG. 10, the signal comparator 18 according to the second embodiment includes the input waveform data generator 21, the received waveform data buffer 22, the predicted waveform data generator 23, the waveform extractor 24, the error detector 25, the coincidence detector 26, the second synchronization processor 27, and an effective value acquisition module 28.

The effective value acquisition module 28 acquires effective results alone from results of comparison between the later-described input waveform data pattern and a predicted waveform data pattern (error detection) to accumulate the number of errors. An operation of the effective value acquisition module 28 will be described later.

FIG. 11A to FIG. 11D are views showing codes of JJY and a data structural example of the input waveform data corresponding to one second in the embodiment. As described above, in the JJY, a position marker code P, a code "0", and a code "1" having a unit time length corresponding to one second are included. Here, in a section of 200 ms at the head of the code (the first section), all the codes indicate the high level (value "1"). In a subsequent section of 300 ms (the second section: 200 ms to 500 ms), the position marker code P alone indicates the low level (value "0"). Furthermore, in a subsequent section of 300 ms (a third section: 500 ms to 800 ms), the code "0" alone indicates the high level (value "1"), and the other code "1" and the position marker code P indicate the low level (value "0"). In the last section of 200 ms (the fourth section: 800 ms to 1000 ms), all the codes indicate the low level (value "0"). In the second embodiment, attention is paid to the first section to the fourth section that are the sections between change points for the values of the codes included in the JJY, i.e., 0 ms, 200 ms, 500 ms, 800 ms, and 1 s, and the input waveform data (a code 1100) (corresponding to one second) associated with one code includes samples values D(0, n), D(1, n), D(2, n), and D(3, n) in the first section to the fourth section (see reference numerals 1101 to 1104).

Likewise, in regard to the predicted waveform data, the predicted waveform data associated with one code includes sample values P(0, p), P(1, p), P(2, p), and P(3, p).

The input waveform data generator 21 according to the second embodiment converts a signal output from the receiver 16 at predetermined sampling intervals (e.g., 64 samples per second) into digital data whose value takes any one of the values "1" and "0" at the predetermined sampling intervals. Moreover, after end of the second synchronization, the input waveform data generator 21 acquires a second sample value to a 12th sample value as the first section in the input waveform data having 64 samples per second, and determines a sample value D(0, n) of the first section based on the value "1" or value "0" which is larger in number. Likewise, the input waveform data generator 21 determines sample values D(1, n), D(2, n), and D(3, n) of the second section to the fourth section based on 14th to 30th sample values, 33rd to 51st sample values, and 53rd to 63rd sample values, respectively. It is to be noted that, like the first embodiment, the CPU 11 can determine the number of sample values in the input waveform data pattern in such a manner that the number of sample values increase, i.e., a data length of the input waveform data becomes long as a reception intensity of the standard time radio wave is reduced.

Figure 12:
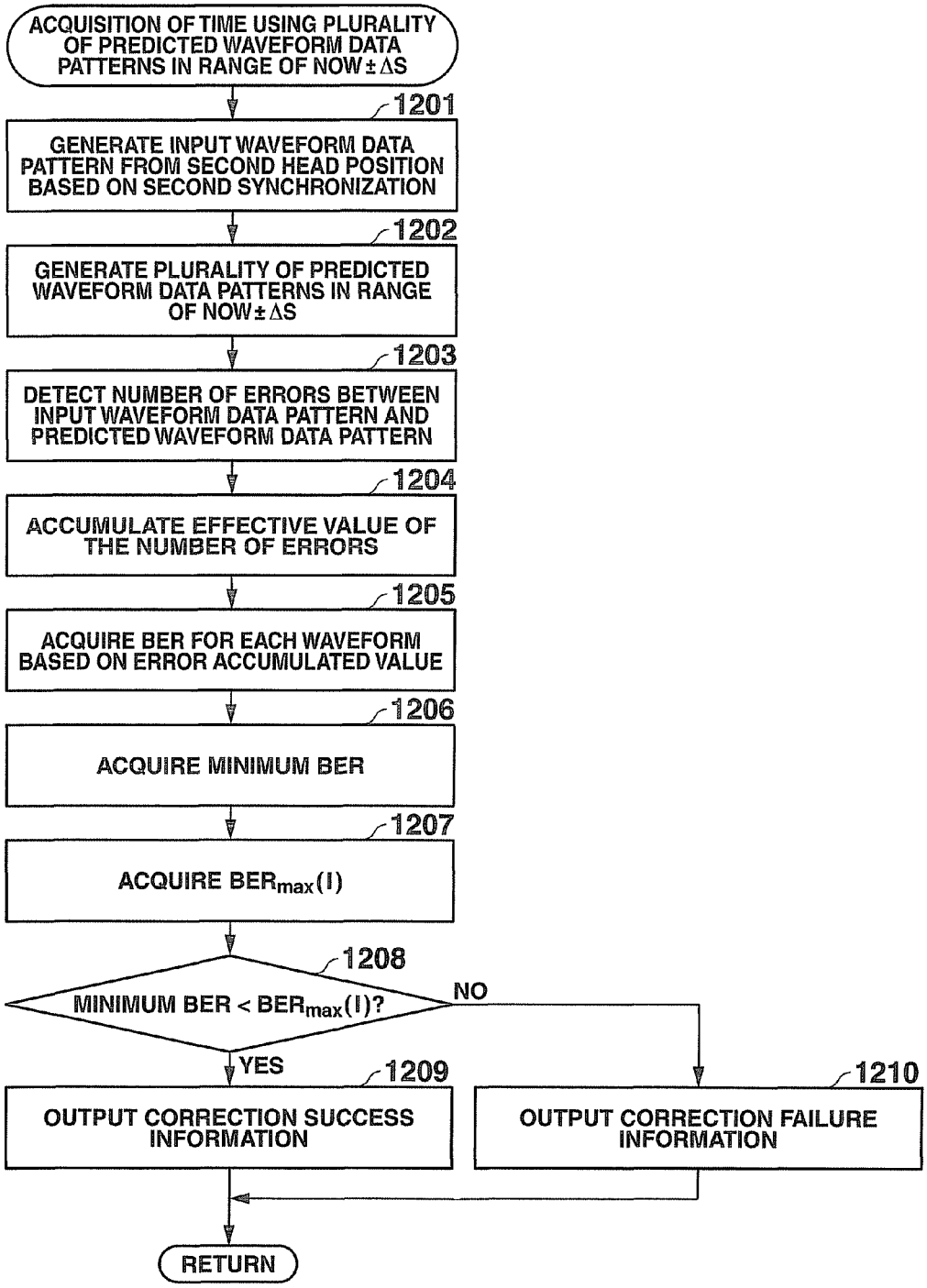
FIG. 12 is a flowchart showing Step 405 according to the second embodiment in more detail.

In the second embodiment, the same processing as that shown in FIG. 4 is executed. If a result of the determination at Step 404 is Yes, the CPU 11 and the signal comparator 18 execute time acquisition processing using the plurality of predicted waveform data patterns according to the embodiment (Step 405). FIG. 12 is a flowchart showing Step 405 according to the second embodiment in more detail.

Figures 13A, 13B, 13C, 13D, 13E, 13F, 13G:
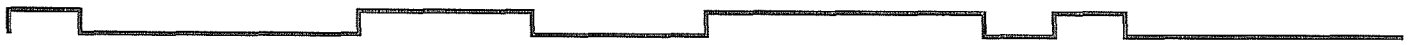
FIG. 13A, FIG. 13B, FIG. 13C, FIG. 13D, FIG. 13E, FIG. 13F, and FIG. 13G are views for explaining input waveform data, an input waveform data pattern, and a plurality of predicted waveform data patterns according to the second embodiment.
Figures 14A, 14B, 14C, 14D, 14E:
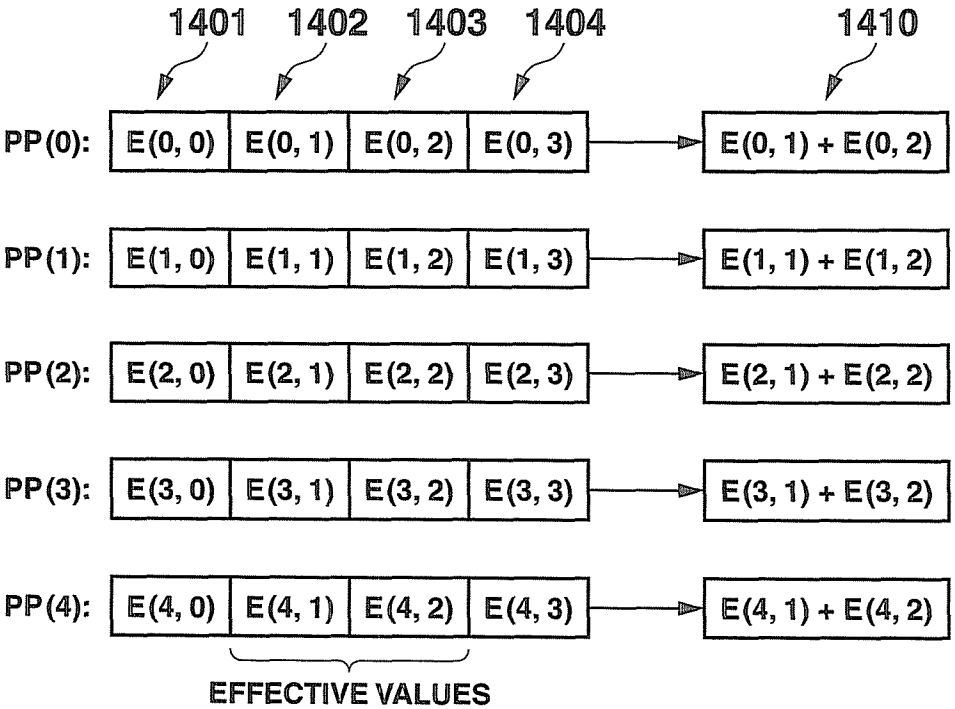
FIG. 14A, FIG. 14B, FIG. 14C, FIG. 14D, and FIG. 14E are views for explaining effective values indicative of the number of errors according to the second embodiment.
Figure 15A:
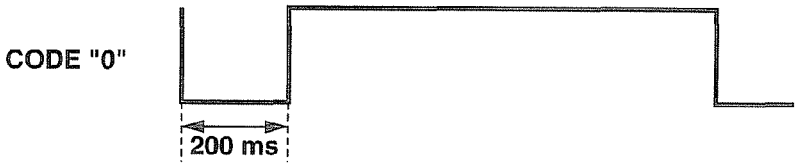
FIG. 15A, FIG. 15B, FIG. 15C, and FIG. 15D are views showing codes of WWVB and a data structural example of input waveform data corresponding to one second in the embodiment.
Figure 15B:
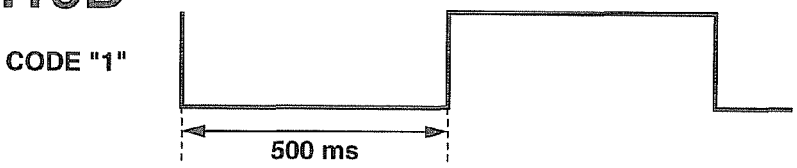
Figure 15C:
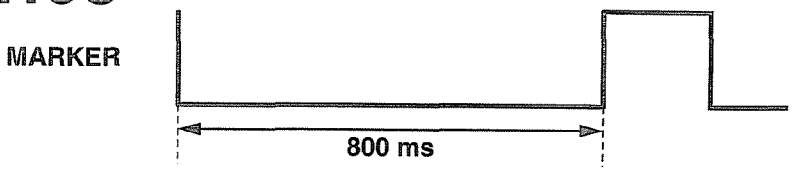
Figure 15D:
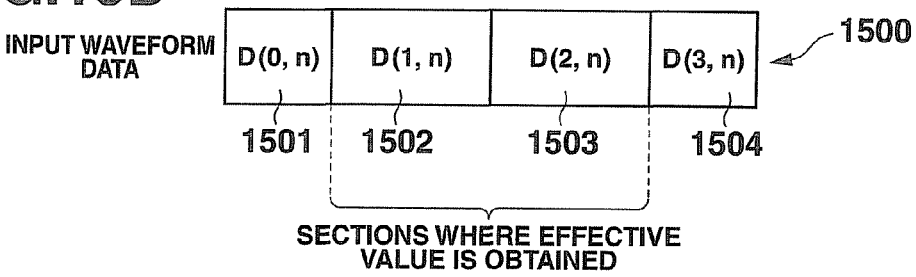
Figure 16A:
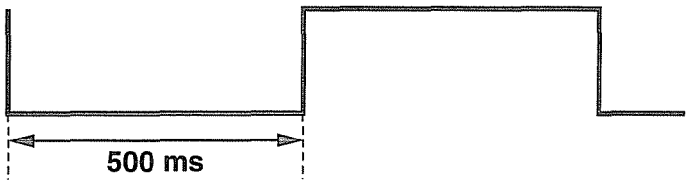
FIG. 16A, FIG. 16B, FIG. 16C, FIG. 16D, FIG. 16E, and FIG. 16F are views showing codes of MSF and a data structural example of input waveform data corresponding to one second in the embodiment.
Figure 16B:
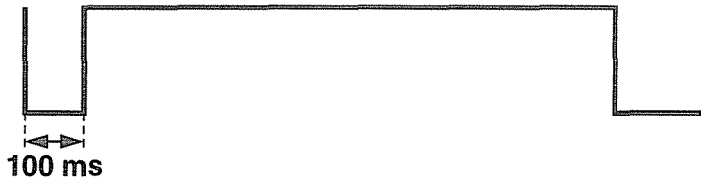
Figure 16C:
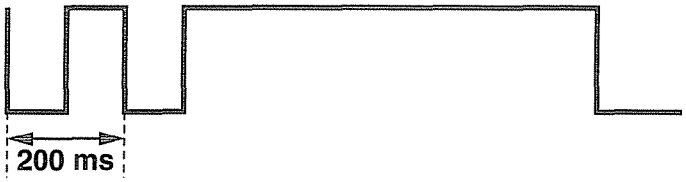
Figure 16D:
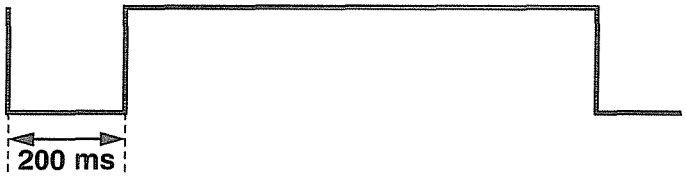
Figure 16E:
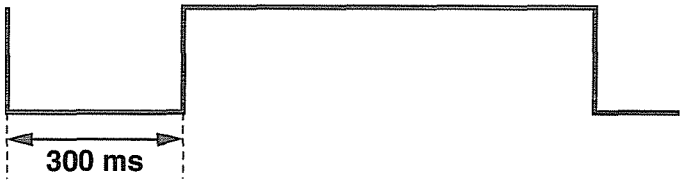
Figure 16F:
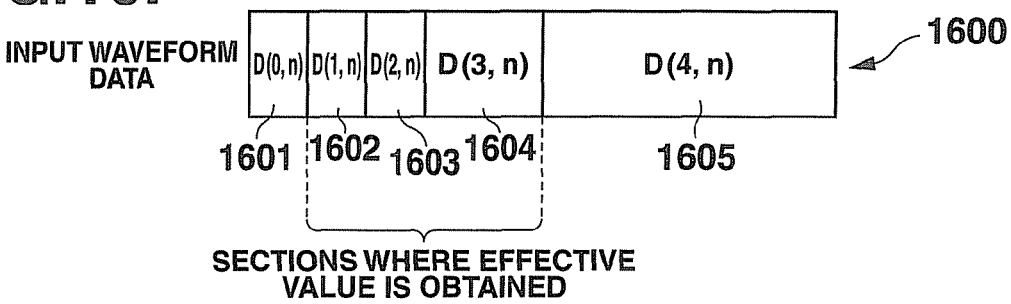

The waveform extractor 24 of the signal comparator 18 reads out the input waveform data (FIG. 13A) from the received waveform data buffer 22 and generates an input waveform data pattern DP (FIG. 13B) having a time length corresponding to a predetermined number of seconds from a second head position NOW+Δt based on the second synchronization. In the example in FIG. 13B, the input waveform data pattern corresponding to four seconds is shown. This input waveform data pattern includes sample values D(0, 0) to D(3, 0) included in first code data, sample values D(0, 1) to D(3, 1) included in second code data, sample values D(0, 2) to D(3, 2) included in third code data, and sample values D(0, 3) to D(3, 3) included in fourth code data.

The predicted waveform data generator 23 generates a plurality of predicted waveform data patterns (FIG. 13C to FIG. 13G) each having a start time deviated in the range of ΔS to be ahead of or behind a processing start time NOW based on the base time BT (Step 1202). In the example shown in FIG. 13C to FIG. 13G, like the first embodiment, assuming that ΔS=−2 to ΔS=2, five predicted waveform data patterns PP(0) to PP(4) are generated.

In the first predicted waveform data pattern PP(0), ΔS=−2 is achieved, i.e., a start time of the pattern is NOW−2, and the first predicted waveform data pattern PP(0) includes first to fourth sample values P(0, −2), P(1, −2), P(2, −2), and P(3, −2) included in the first code data, first to fourth sample values P(0, −1), P(1, −1), P(2, −1), and P(3, −1) included in the second code data, first to fourth sample values P(0, 0), P(1, 0), P(2, 0), and P(3, 0) included in the third code data, and first to fourth sample values P(0, 1), P(1, 1), P(2, 1), and P(3, 1) included in the fourth code data.

In the second predicted waveform data pattern PP(1), ΔS=−1 is achieved, and a start time of the pattern is NOW−1. In the third predicted waveform data pattern PP(2), ΔS=0 is achieved, and a start time of the pattern is NOW. In the fourth predicted waveform data pattern data PP(3), ΔS=1 is achieved, and a start time of the pattern is NOW+1. In the fifth predicted waveform data pattern data PP(4), a start time of the pattern is NOW+2.

The error detector 25 compares the input waveform data pattern DP with each of the plurality of predicted waveform data patterns in corresponding codes to calculate the number of errors corresponding to non-coincidence of codes (Step 1203). In an example in FIG. 13A to FIG. 13G, the input waveform data pattern DP is compared with each of the predicted waveform data patterns PP(0) to PP(4).

In the embodiment, the input waveform data corresponding to one second in the input waveform data pattern has four sample values, and the predicted waveform data corresponding to one second in the predicted waveform data pattern likewise has four sample values. Therefore, coincidence/non-coincidence of four pairs of sample values associated with each other is detected every second.

For example, for the first code data D(0, 0) to D(3, 0) of the input waveform data pattern and the first code data P(0, −2) to P(3, −2) of the predicted waveform data pattern PP(0), D(0, 0) and P(0, −2); D(1, 0) and P(1, −2); D(2, 0) and P(2, −2); and D(3, 0) and P(3, −2) are compared to detect coincidence or non-coincidence.

In case of non-coincidence, the number of errors is 1, and the error detector 25 accumulates the number of errors of each of the first sample value to the fourth sample value. In the input waveform data pattern and the predicted waveform data pattern PP(0), E(0, 0) (see reference numeral 1401 in FIG. 14A to FIG. 14E) which is the number of errors in the first section (a sum total of the respective numbers of errors in D(0, s) (s=0 to 3) and P(0, t) (t=−2 to 1)), E(0, 1) (see reference numeral 1402 in FIG. 14A to FIG. 14E) which is the number of errors in the second section (a sum total of the respective numbers of errors in D(1, s) (s=0 to 3) and P(1, t) (t=−2 to 1)), E(0, 2) (see reference numeral 1403 in FIG. 14A to FIG. 14E) which is the number of errors in the third section (a sum total of the respective numbers of errors in D(2, s) (s=0 to 3) and P(2, t) (t=−2 to 1)), and E(0, 3) (see reference numeral 1404 in FIG. 14A to FIG. 14E) which is the number of errors in the fourth section (a sum total of the respective numbers of errors in D(3, s) (s=0 to 3) and P(3, t) (t=−2 to 1)) can be obtained. In regard to the other predicted waveform data patterns PP(1) to PP(4), the number of errors in each of the first to fourth sections can be likewise acquired.

Figure 11A:
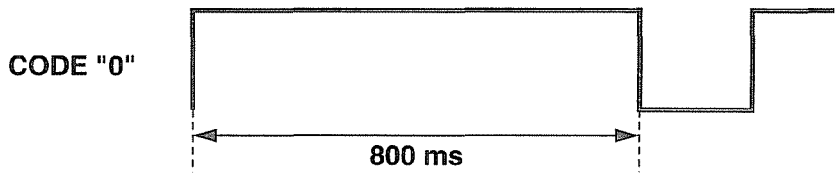
FIG. 11A, FIG. 11B, FIG. 11C, and FIG. 11D are views showing codes of the JJY and a data structural example of input waveform data corresponding to one second in the embodiment.
Figure 11B:
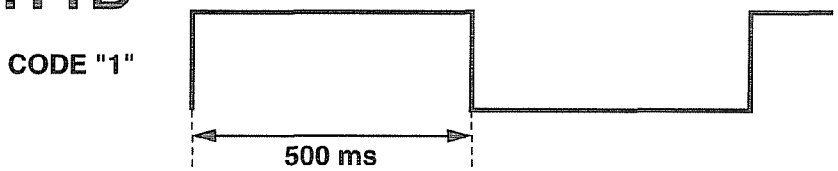
Figure 11C:
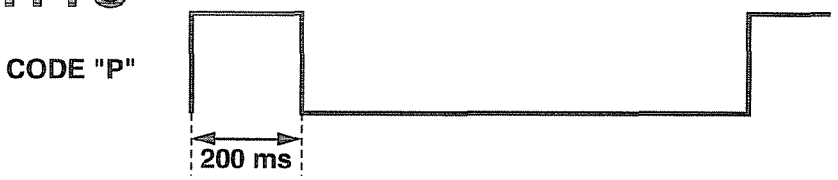
Figure 11D:
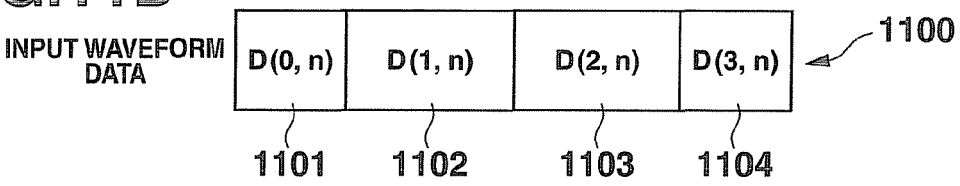

As shown in FIG. 11A to FIG. 11C, in the first section, all of the code "0", the code "1", and the position marker code P take value "1". Furthermore, in the fourth section, all of the code "0", the code "1", and the position marker P take value "0". On the other hand, in the second section, the position marker code P takes a value different from those of the other codes. Moreover, in the third section, the code "0" takes a value different from those of the other codes. Therefore, making reference to the values in the second section and the third section enables specifying each code.

In the second embodiment, the effective value acquisition module 28 determines the sum totals of the numbers of errors in the second section and the third section in each predicted waveform data pattern as effective values, adds the sum totals of the numbers of errors in the second section and the third section, and determines a result of this addition as a final sum total of the numbers of errors (Step 1204, see reference numeral 1410 in FIG. 14A to FIG. 14E).

The coincidence detector 26 calculates a bit error rate (BER) associated with each of the plurality of predicted waveform data patterns based on the number of errors (a final sum total of the number of errors) calculated in regard to each of the plurality of predicted waveform data patterns (Step 1205). Like the first embodiment, the bit error rate (BER) can be obtained by calculating (the final sum total of the number of errors)/(the number of sample values I). The coincidence detector 26 finds a minimum bit error rate (a minimum BER) in the bit error rates BER (Step 1206). Then, the coincidence detector 26 acquires an allowable maximum bit error rate $BER_{max}(I)$ determined by the number of pieces of received code data (I) (Step 1207) and determines whether the minimum BER is smaller than the allowable maximum bit error rate $BER_{max}(I)$ (Step 1208).

If a result of the determination is Yes at Step 1208, the coincidence detector 26 outputs information indicative of success in correction as correction information and information of the predicted waveform data pattern indicative of the minimum BER (information indicative of deviation from BT) to the CPU 11 (Step 1209). If a result of the determination at Step 1208 is No, the coincidence detector 26 outputs information indicative of failure in correction as the correction information to the CPU 11 (Step 1210).

According to the second embodiment, the number of comparisons of the sample values per second (code) is larger than that in the first embodiment (quadruple). Therefore, with reference to the number of samples to be received, quadruple data as compared with the first embodiment is received. Therefore, a reception time can be further reduced (approximately ¼) as compared with the first embodiment.

It is assumed that N is the number of received bits (the numbers of samples) and "e" is the number of allowable error bits. Additionally, like the first embodiment, bias of a probability of occurrence of each code is assumed to be P0=0.55 or P1=0.45. A probability of non-coincidence is set to $1/10^8$ like the first embodiment. Under such conditions, $P0^N \times COMBIN(N, e) < 1/10^8$ is solved in regard to "e" to calculate the number of allowable error bits and BER at this moment.

In the following description, N is the number of received bits (the number of samples) and S is the number of seconds in reception at this moment.

$S=10, N=40, e=1$, BER=0.1

$S=20, N=80, e=10$, BER=0.125

$S=30, N=120, e=21$, BER=0.175

$S=40, N=160, e=31$, BER=0.194

$S=50, N=200, e=42$, BER=0.210

$S$=60, $N$=240, $e$=53, BER=0.221

$S$=90, $N$=360, $e$=87, BER=0.242

Comparing with the first embodiment, it can be understood that the same allowable BER can be obtained in a reception time which is ¼ of that in the first embodiment.

According to the second embodiment, in the input waveform data pattern generated by the waveform extractor 24, a sample value of each sample point takes either the first value indicative of the low level or the second value indicative of the high level, and the sample value is a value in a section between change points of a value of any code included in the standard time radio wave. The error detector 25 determines coincidence/non-coincidence of the sample value of the input waveform data pattern and the corresponding sample value of the predicted waveform data pattern, counts the number of errors indicative of non-coincidence, and acquires the number of errors in each section in each of the plurality of predicted waveform data patterns. Further, the effective value acquisition module 28 calculates—the number of effective errors which is the number of errors concerning an effective section in the numbers of errors in the respective sections. The coincidence detector 26 calculates an error of the base time BT based on a head position of the predicted waveform data pattern indicative of the number of effective errors which is a minimum value.

In the second embodiment, the input waveform data pattern including the sample values at the plurality of sample points per unit time corresponding to each code is generated, and it is compared with the predicted waveform data pattern having the same time length and the same number of samples as those of the input waveform data pattern. That is, coincidence/non-coincidence at the plurality of sample points per unit time is determined. Therefore, a data length of the input waveform data pattern can be reduced, thereby shortening the reception time.

Further, in the second embodiment, the effective section is such a section as that a value of any code included in the standard time radio wave takes a value different from those of the other codes. That is, a section in which the sample value has no change in the predicted waveform data pattern is eliminated from error number calculation targets, and a section in which the sample value changes depending on the predicted waveform data pattern is determined as an effective section and an error number calculation target. Therefore, the appropriate number of errors can be calculated in the reduced number of sections by the reduced number of calculations.

Furthermore, in the second embodiment, the CPU 11 determines the predetermined number of seconds based on a time difference between a time obtained by correcting the base time and a current base time and a predetermined timer accuracy, and determines the number of the predicted waveform data patterns to be generated. Therefore, according to the second embodiment, the number of predicted waveform data patterns is determine based on a time interval from the previous correction, thus avoiding an increase in processing time due to generation of many predicted waveform data patterns.

In the second embodiment, the generated input waveform data pattern has one sample value in accordance with each section. The input waveform data generator 21 and the waveform extractor 24 acquire data values at temporally different positions in accordance with each section in acquisition of the sample value and determine the sample value with respect to the corresponding section. As a result, a data length of the input waveform data pattern can be reduced while assuring adequacy of the sample value of the input waveform data pattern, whereby the processing time can be further reduced.

In the second embodiment, when a minimum value of the number of effective errors is smaller than an allowable maximum number of errors predetermined in accordance with the number of samples, the coincidence detector 26 acquires an error of the base time based on the head position of the predicted waveform data pattern indicative of the number of effective errors which is the minimum number. As a result, the possibility of erroneous detection can be greatly reduced.

In the second embodiment, the CPU 11 determines the number of sample values in such a manner that this number increases as a reception intensity of the received standard time radio wave decreases, and the input waveform data pattern is generated in accordance with the determined number of sample values. Therefore, the input waveform data pattern and the predicted waveform data pattern each having an optimum data length associated with the reception intensity can be generated.

While the description above refers to particular embodiments of the present invention, it will be understood that the present invention can be modified in many ways within the scope of the invention disclosed in claims without being restricted to the foregoing embodiments and various modifications are included in the scope of the invention.

For example, in the first embodiment and the second embodiment, when the obtained minimum BER is equal to or above the allowable maximum bit error $BER_{max}(I)$, it is determined that a correction is failed (see Steps 1208 and 1210). In this case, Step 405 may be again executed. In re-execution of Step 405, the number of seconds (i.e., the number of codes) in the input waveform data pattern is set to be larger than the number of seconds in the input waveform data pattern generated at the previous Step 405. When the reception time is prolonged and the number of bits (the number of sample values) N is increased, a possibility of enabling the time correction becomes high.

In the second embodiment, the standard time radio wave conforming to the JJY is received, and the sample value of each of sections between change points of a value of each code included in the JJY, i.e., 0 ms, 200 ms, 500 ms, and 800 ms is obtained. The present invention can be also applied to a standard time radio wave conforming to other standards than the JJY. FIG. 15A to FIG. 15D are views showing codes of WWVB and a data structural example of input waveform data corresponding to one second.

In the WWVB, like the JJY, a value of any code changes at 0 ms, 200 ms, 500 ms, and 800 ms. In a section of 200 ms at a head of each code (the first section), all codes indicate the low level (value "0"). In a subsequent section of 300 ms (the second section: 200 ms to 500 ms), the code "0" alone indicates the high level (value "1"). Moreover, in a subsequent section of 300 ms (the third section: 500 ms to 800 ms), the marker code alone indicates the low level (value "0"), and the other codes "0" and "1" indicate the high level (value "1"). In a last section of 200 ms (the fourth section: 800 ms to 1000 ms), all the codes indicate the high level (value "1"). Therefore, even in case of receiving a signal of the standard time radio wave conforming to the WWVB to acquire time information, input waveform data (reference numeral: 1500) corresponding to a code includes sample values D(0, n), D(1, n), D(2, n), and D(3, n) in the first section to the fourth section, respectively (see reference numerals 1501 to 1504).

Even in case of codes conforming to the WWVB, all the codes take the same value in the first section and the fourth section, but any code takes a value different from those of the other codes in the second section and the third section. Therefore, in case of receiving a signal of the standard time radio wave conforming to the WWVB to acquire the time information, sum totals of the numbers of errors in the second section and the third section are determined as effective values, and the sum totals of the numbers of errors in the second section and the third section may be added, whereby a result of this addition is given as a final sum total of the number of errors (see Step 1204 in FIG. 12).

FIG. 16A to FIG. 16F are views showing codes of MSF and a data structural example of input waveform data corresponding to one second. In the MSF, a value of any code changes at 0 ms, 100 ms, 200 ms, 300 ms, and 500 ms. That is, in the first section of 0 ms to 100 ms, five types of codes all indicate the low level (value "0"). In the second section of 100 ms to 200 ms, a code "10", a code "11", and a marker code indicate the low level (value "0"), and other codes indicate the high level (value "1"). In the third section of 200 ms to 300 ms, a code "01", the code "11", and the marker code indicate the low level (value "0"), and other codes indicate the high level (value "1"). In the fourth section of 300 ms to 500 ms, the marker code alone indicates the low level (value "0"), and the other codes indicate the high level (value "1"). In the fifth section of 500 ms to 1000 ms, all the codes indicate the high level (value "1").

Therefore, even in case of receiving a signal of the standard time radio wave conforming to the MSF to acquire the time information, input waveform data (see reference numeral 1600) (corresponding to one second) corresponding to one code includes sample values D(0, n), D(1, n), D(2, n), D(3, n), and D(4, n) in the first section to the fifth section, respectively (see reference numerals 1601 to 1065).

Even in case of codes conforming to the MSF, all the codes take the same value in the first section and the fifth section, but any code takes a value different from those of the other codes in the second section, the third section, and the fourth section. Therefore, in case of receiving a signal of the standard time radio wave conforming to the MSF to acquire the time information, sum totals of the numbers of errors in the second section, the third section, and the fourth section are determined as effective values, and the sum totals of the numbers of errors in the second section, the third section, and the fourth section may be added, whereby a result of this addition is given as a final sum total of the number of errors (see Step 1204 in FIG. 12).

In the first embodiment and the second embodiment, although the minimum BER is compared with the allowable maximum bit error $BER_{max}(I)$, the present invention is not restricted thereto, and other techniques may be adopted.

Figure 17:
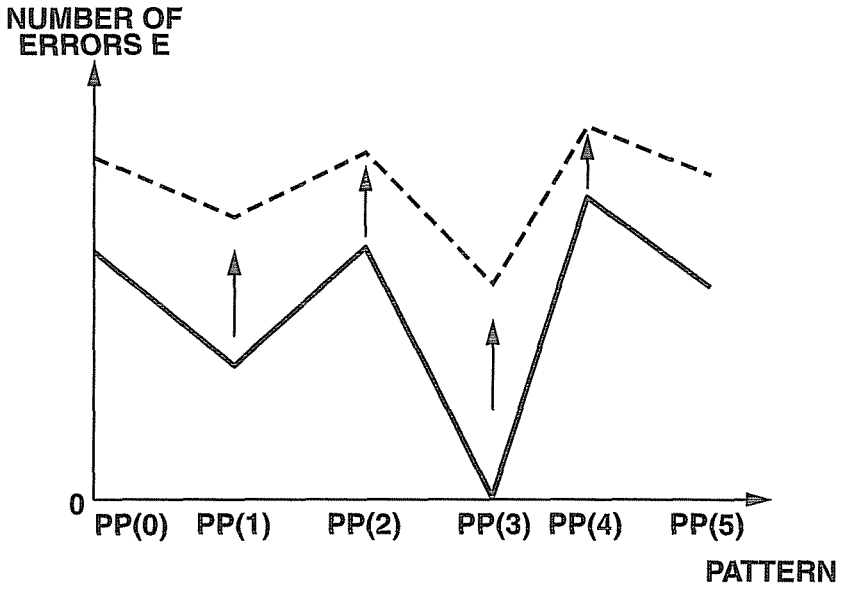
FIG. 17 is an example of a graph showing the number of errors for each predicted waveform data pattern.

For example, if a signal of a received standard time radio wave does not contain noise, the number of errors in an input waveform data pattern and a predicted waveform data pattern associated with a time which should be corrected is 0 (i.e., the bit error rate BER is also 0). For example, in FIG. 17 showing the number of errors of a predicted waveform data pattern, a graph of a solid line indicates the number of errors in each predicted waveform data pattern PP when a reception status of the standard time radio wave is excellent. As described above, when the reception status is excellent and the signal does not contain noise, the number of errors in a predicted waveform data pattern PP(3) is "0", whereby the predicted waveform data pattern PP(3) can be determined as a pattern that coincides with the input waveform data pattern.

However, since the signal of the standard time radio wave actually contains noise, the number of errors (and the bit error rate BER) takes a value larger than "0", and the number of errors (and the bit error rate BER) increases as the noise intensifies (see a broken line in FIG. 17).

Figure 18A:
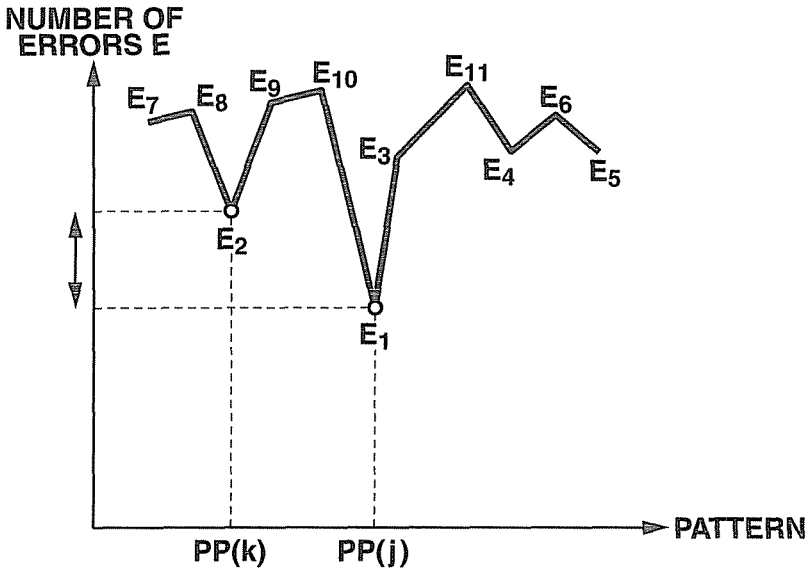
FIG. 18A and FIG. 18B are other graphs each showing correspondence of each predicted waveform data pattern and the number of errors.
Figure 18B:
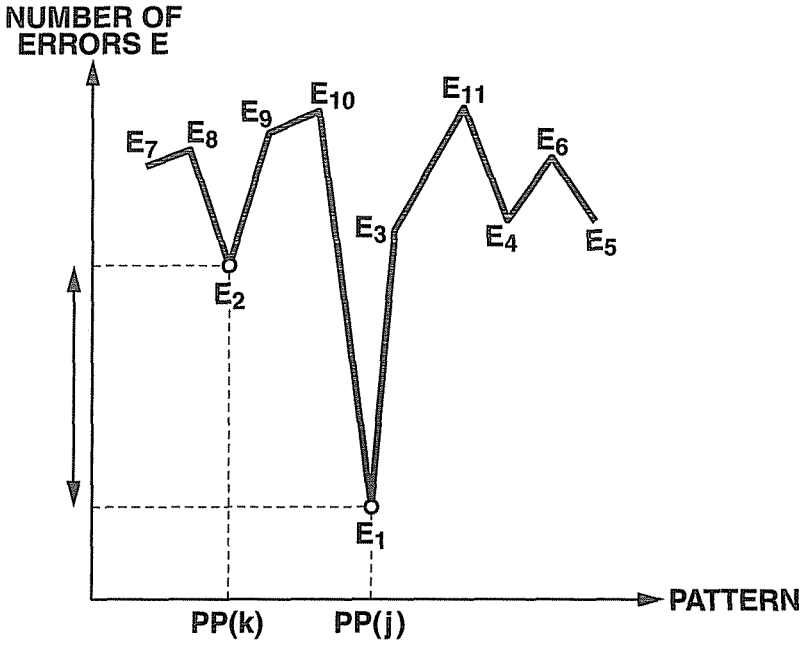

Each of FIG. 18A and FIG. 18B is a modification of a graph showing correspondence between predicted waveform data patterns and the number of errors. In the modification shown in each of FIG. 18A and FIG. 18B, marks $E_1, E_2, \ldots$ are given to the numbers of errors in an ascending order. As shown in FIG. 18A, when a minimum value $E_1$ of the number of errors is relatively close to a second minimum value $E_1$, it may be possibly undesirable to determine a predicted waveform data pattern PP(j) indicating the minimum value $B_1$ to coincide with the input waveform data pattern as compared with a case that $E_1$ is greatly apart from E (see FIG. 18B).

Thus, in this modification, when the minimum value $E_1$ of the number of errors is apart from the second minimum value $E_2$ beyond a predetermined level, the minimum value $E_1$ is determined to be reliable. To determine whether these values are apart from each other beyond a predetermined level, a lower limit of the second minimum value $E_2$ is determined based on an error rate $P_d$, the number of samples N, and the minimum value $E_1$ of the number of errors.

Assuming that P is the error rate indicating that the minimum value E1 of the number of errors does not correspond to a coincidence point (i.e., a point indicative of coincidence with the input waveform data pattern), P can be represented as a function of N, $E_1$, and $E_2$ described above.

$$P=f(N,E_1,E_2)$$

More specifically, for example, P can be represented by the following expression.

$$f(N, E_1, E_2) = \left(1 - \frac{E_1}{N}\right)^{N-E_2} \cdot \left(\frac{E_1}{N}\right)^{E_2} \cdot {}_N C_{E_2} \tag{1}$$

where N>0 and $E_1<E_2$.

When the error rate P is used and the error rate P (=f(N, $E_1$, $E_2$)) is smaller than a judgment reference value Pd (e.g., Pd=$1e^{-8}$), i.e., when f(N, $E_1$, $E_2$)<Pd is achieved, setting the error point $E_1$ as a coincidence point is determined to be sufficiently reliable.

The error rate P may actually be obtained in accordance with Equation (1) described above, and the error rate P may be compared with the predetermined judgment reference value Pd, but this process may take a calculation time. Therefore, the RAM 15 may store a reliability judgment table showing a lower limit value of $E_2$ meeting f(N, $E_1$, $E_2$)<Pd with respect to each combination of the number of samples N and the minimum value $E_1$ of the number of errors, whereby a value in the reliability judgment table may be read out at the time of processing. For example, as shown in FIG. 19, a reliability judgment table 1900 stores a lower limit value $E_{min}$(N, $E_1$) of $E_2$ in regard to each (N, $E_1$) as the number of samples N (N=1, 2, 3, 4, . . . in the modification depicted in FIG. 19) and the minimum value ($E_1$=1, 2, . . . ) of the number of errors.

Figure 20:
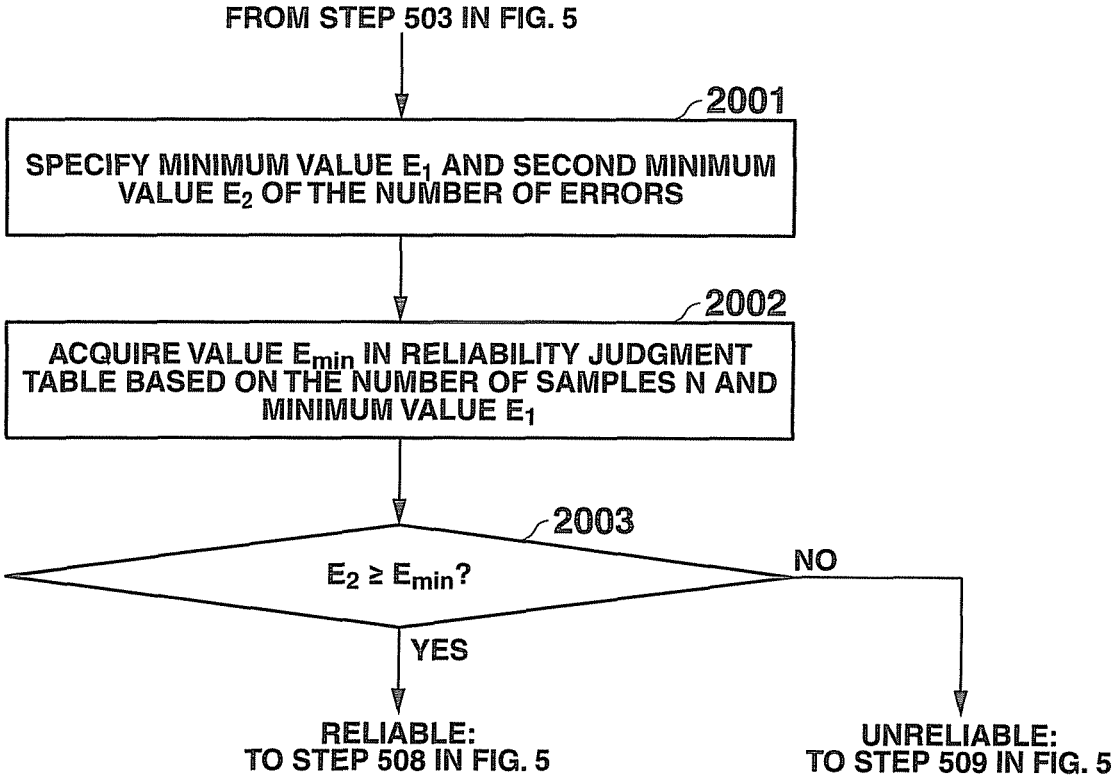
FIG. 20 is a flowchart showing an example of a coincidence detection according to a modification of the invention.

FIG. 20 is a flowchart showing an example of reliability judgment processing according to the modification. The processing shown in FIG. 20 is executed in place of Step 504 to Step 507 in FIG. 5 according to the first embodiment. As shown in FIG. 20, the coincidence detector 26 specifies the minimum value $E_1$ and the second minimum value $E_2$ of the number of errors based on the number of errors for each predicted waveform data pattern (Step 2001). Then, the coincidence detector 26 refers to the reliability judgment table in the RAM 15 to acquire a corresponding lower limit value $E_{min}$(N, $E_1$) based on the number of samples N and the minimum value $E_1$ (Step 2002).

The coincidence detector 26 determines whether the value $E_2$ is not lower than the lower limit value $E_{min}$ (Step 2003). If a result of the determination at Step 2003 is Yes, coincidence is determined to be reliable, and the processing advances to Step 508. On the other hand, if a result of the determination at Step 2003 is No, the coincidence is determined to be unreliable, and the processing advances to Step 509. The above-described technique can be likewise applied to the second embodiment.

In the second embodiment, at Step 2001, the minimum value $E_1$ of accumulated values of effective values and the second minimum value $E_2$ of the accumulated values of the effective values are specified. Further, the coincidence detector 26 may acquire a lower limit value $E_{min}$ by using $E_1$ and $E_2$ based on the accumulated values of the effective values.

According to the foregoing embodiment, not only the minimum value $E_1$ of the number of errors but also the second minimum value $E_2$ are taken into consideration, and coincidence of a predicted waveform data pattern with an input waveform data pattern in regard to the minimum value $E_1$ is determined to be reliable if the minimum value $E_1$ is apart from the second minimum value $E_2$ beyond a predetermined level. As a result, determination of highly reliable coincidence can be realized.

What is claimed is:

1. A time information acquisition apparatus comprising:

an input waveform data pattern generator configured to sample a standard time radio wave signal including a time code indicative of time information from a second head position detected at the standard time radio wave signal in a predetermined sampling cycle in order to generate an input waveform data pattern having one or more unit time lengths, wherein a sample value at a sample point in the input waveform data pattern is one of a first value indicative of a low level and a second value indicative of a high level;

a predicted waveform data pattern generator configured to generate predicted waveform data patterns each having the one or more unit time lengths, represents a string of codes based on a base time measured by an internal timer, and has a head position indicative of the base time or a time preceding or succeeding to the base time by a predetermined number of seconds, wherein a sample value at a sample point in the predicted waveform data pattern is one of the first value and the second value;

an error detector configured to detect non-coincidence between the sample value of the input waveform data pattern and the sample value of each of the predicted waveform data patterns in order to acquire a number of errors indicative of a number of non-coincidences of each of the plurality of predicted waveform data patterns;

a current time correction module configured to correct the base time based on the head position of the predicted waveform data pattern indicative of a minimum value of the number of errors; and a controller configured to determine the predetermined number of seconds based on a time difference between the base time corrected by the current time correction module and a current base time and a predetermined timer accuracy in order to determine the number of predicted waveform data patterns to be generated.

2. The apparatus according to claim 1, wherein the input waveform data pattern generated by the input waveform data pattern generator has one sample value in accordance with each code, and the input waveform data pattern generator is configured to acquire data values at a plurality of temporally different positions in accordance with each code at a time of acquiring the sample value in order to determine a sample value of the code based on acquire data values.

3. The apparatus according to claim 1, wherein the current time correction module is configured to correct the base time based on the head position of the predicted waveform data pattern indicative of a minimum value of the number of errors when the minimum value of the number of errors is smaller than an allowable maximum number of errors determined in accordance with a number of samples.

4. The apparatus according to claim 1, wherein the current time correction module is configured to correct the base time based on the head position of the predicted waveform data pattern indicative of a minimum value of the number of errors when the minimum value is apart from a second minimum value of the number of errors by a predetermined level or more.

5. The apparatus according to claim 2, wherein the current time correction module is configured to correct the base time based on the head position of the predicted waveform data pattern indicative of a minimum value of the number of errors when the minimum value is apart from a second minimum value of the number of errors by a predetermined level or more.

6. The apparatus according to claim 1, wherein the controller is configured to determine a number of sample values based on a reception intensity of a received standard time radio wave wherein the number increases when the reception intensity decreases, and the input waveform data pattern generator is configured to generate the input waveform data pattern in accordance with a determined number of sample values.

7. The apparatus according to claim 1, wherein the controller is configured to calculate an estimated maximum error based on the time difference and the timer accuracy, and the predicted waveform data generator is configured to generate predicted waveform data patterns each having the head position falling within the maximum error range.

8. A radio wave timepiece comprising:

the time information acquisition apparatus according to claim 1;

the internal timer configured to count a current time based on an internal clock; and a time display device configured to display the current time measured by the internal timer or the current time corrected by the current time correction module.

9. A time information acquisition apparatus comprising:

an input waveform data pattern generator configured to sample a standard time radio wave signal detected at the standard time radio wave signal including a time code indicative of time information from a second head position in a predetermined sampling cycle in order to generate an input waveform data pattern having one or more unit time lengths, wherein a sample value at a sample point in the input waveform data pattern is one of a first value indicative of a low level and a second value indicative of a high level, and the sample value is a value in a section between change points of a value of a code included in the standard time radio wave;

a predicted waveform data pattern generator configured to generate predicted waveform data patterns each having the one or more unit time lengths, represents a string of codes based on a base time measured by an internal timer, and has a head position indicative of the base time or a time preceding or succeeding to the base time by a predetermined number of seconds, wherein a sample value at a sample point in the predicted waveform data pattern is one of the first value and the second value, a number of samples of the predicted waveform data patterns is equals to a number of samples of the input waveform data pattern;

an error detector configured to detect non-coincidence between the sample value of the input waveform data pattern and the sample value of each of the predicted waveform data patterns in order to acquire a number of errors indicative of a number of non-coincidences of each of the plurality of predicted waveform data patterns for each of the sections of each of the plurality of predicted waveform data patterns;

an effective value calculator configured to calculate a number of effective errors, which is a number of errors concerning an effective section, in the number of errors for each of the sections; and a current time correction module configured to correct the base time based on the head position of the predicted waveform data pattern indicative of a minimum value of the number of errors.

10. The apparatus according to claim 9, wherein the effective section comprises a section in which a value of one of codes included in the standard time radio wave signal differs from a value of another code included in the standard time radio wave signal.

11. The apparatus according to claim 9, further comprising:

a controller configured to determine the predetermined number of seconds based on a time difference between the base time corrected by the current time correction module and a current base time and a predetermined timer accuracy in order to determine the number of predicted waveform data patterns to be generated.

12. The apparatus according to claim 10, further comprising:

a controller configured to determine the predetermined number of seconds based on a time difference between the base time corrected by the current time correction module and a current base time and a predetermined timer accuracy in order to determine the number of predicted waveform data patterns to be generated.

13. The apparatus according to claim 9, wherein the input waveform data pattern generated by the input waveform data pattern generator has one sample value in accordance with each code, and the input waveform data pattern generator is configured to acquire data values at a plurality of temporally different positions in accordance with each code in order to determine a sample value of the code based on acquire data values.

14. The apparatus according to claim 10, wherein the input waveform data pattern generated by the input waveform data pattern generator has one sample value in accordance with each code, and the input waveform data pattern generator is configured to acquire data values at a plurality of temporally different positions in accordance with each code in order to determine a sample value of the code based on acquire data values.

15. The apparatus according to claim 9, wherein the current time correction module is configured to correct the base time based on the head position of the predicted waveform data pattern indicative of a minimum value of the number of errors when the minimum value of the number of errors is smaller than an allowable maximum number of errors determined in accordance with a number of samples.

16. The apparatus according to claim 10, wherein the current time correction module is configured to correct the base time based on the head position of the predicted waveform data pattern indicative of a minimum value of the number of errors when the minimum value of the number of errors is smaller than an allowable maximum number of errors determined in accordance with a number of samples.

17. The apparatus according to claim 9, wherein the current time correction module is configured to correct the base time based on the head position of the predicted waveform data pattern indicative of a minimum value of the number of errors when the minimum value is apart from a second minimum value of the number of errors by a predetermined level or more.

18. The apparatus according to claim 9, further comprising a controller configured to determine a number of sample values based on a reception intensity of a received standard time radio wave wherein the number increases when the reception intensity decreases, and wherein the input waveform data pattern generator is configured to generate the input waveform data pattern in accordance with a determined number of sample values.

19. A radio wave timepiece comprising:

the time information acquisition apparatus according to claim 9;

the internal timer configured to count a current time based on an internal clock: and a time display device configured to display the current time measured by the internal timer or the current time corrected by the current time correction module.

* * * * *